US012291944B1

(12) United States Patent
Kazei et al.

(10) Patent No.: US 12,291,944 B1
(45) Date of Patent: May 6, 2025

(54) SYSTEM AND METHOD FOR DEPLOYING FIBER OPTIC CABLES WITH A CURED-IN-PLACE PIPE LINER

(71) Applicant: ARAMCO SERVICES COMPANY, Houston, TX (US)

(72) Inventors: Vladimir Kazei, Houston, TX (US); Ezzedeen Alfataierge, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/486,734

(22) Filed: Oct. 13, 2023

(51) Int. Cl.

| | |
|---|---|
| ***E21B 43/10*** | (2006.01) |
| ***E21B 33/14*** | (2006.01) |
| ***E21B 43/08*** | (2006.01) |
| ***E21B 47/135*** | (2012.01) |

(52) U.S. Cl.
CPC ..... *E21B 43/103* (2013.01); *E21B 33/14* (2013.01); *E21B 43/08* (2013.01); *E21B 43/10* (2013.01); *E21B 47/135* (2020.05)

(58) Field of Classification Search
CPC ..... E21B 43/103; E21B 33/14; E21B 43/08; E21B 43/10; E21B 47/135
See application file for complete search history.

(56) References Cited

U.S. PATENT DOCUMENTS 4,064,211 A * 12/1977 Wood ..... B29C 63/0069 264/516
8,162,535 B2 4/2012 Glombitza
8,940,113 B2 1/2015 Lindner et al.
2004/0144535 A1 7/2004 Kalman et al.
2012/0255664 A1 10/2012 Lindner et al.
2021/0347106 A1 11/2021 Morris
2022/0228482 A1 * 7/2022 Hampton ..... E21B 49/006
(Continued)

FOREIGN PATENT DOCUMENTS

WO 2020009929 A1 1/2020

OTHER PUBLICATIONS

Bakku, S.K. et al., "Vertical Seismic Profiling Using Distributed Acoustic Sensing in a Hydrofrac Treatment Well," Society of Exploration Geophysicists, pp. 5024-5028, 2014 (5 pages).
(Continued)

*Primary Examiner* — Brad Harcourt
(74) *Attorney, Agent, or Firm* — Osha Bergman Watanabe & Burton LLP

(57) ABSTRACT

A system may include a wellbore extending a first depth into a formation. Additionally, a cured-in-place pipe liner may be coupled to walls of the wellbore. One or more fiber optic cables are embedded in the cured-in-place pipe liner to monitor a curing of the cured-in-place pipe liner and record well data. The one or more fiber optic cables may be used to continuously monitor the wellbore during a method for lining the wellbore is performed. The method for lining the wellbore may include inserting the cured-in-place pipe liner into the wellbore; forcing the cured-in-place pipe liner against walls of the wellbore; curing the cured-in-place pipe liner; monitoring the curing of the cured-in-place pipe liner with the one or more fiber optic cables embedded in the cured-in-place pipe liner; and coupling the cured-in-place pipe liner to the walls of the wellbore.

17 Claims, 17 Drawing Sheets

(56) References Cited

U.S. PATENT DOCUMENTS

2023/0052444 A1* 2/2023 Wilson ..... E21B 47/001
2023/0243695 A1* 8/2023 LeBlanc ..... G01V 1/226
166/250.01

OTHER PUBLICATIONS

Byerley, G., et al., "Time-lapse seismic monitoring of individual hydraulic frac stages using a downhole DAS array," The Leading Edge, 2018 (9 pages).
Correa, J., et.al., "Analysis of signal to noise and directivity characteristics of DAS VSP at near and far offsets—A CO2CRC Otway Project data example," The Leading Edge, 2017 (7 pages).
Daley, T.M. et al., "Field testing of fiber-optic distributed acoustic sensing (DAS) for subsurface seismic monitoring," The Leading Edge, No. 32, pp. 699-706, Jun. 2013 (7 pages).
Das, S., et al., "A comprehensive review on the challenges of cured-in-place pipe (CIPP) installations," Journal of Water Supply: Research and Technology—AQUA, 2016 (15 pages).
Arthur Hartog, "An Introduction to Distributed Optical Fibre Sensors," CRC Press, 2017 (96 pages).
Kasahara, J. et al., "Seismic Feasibility Study to Identify and Characterize Supercritical Geothermal Reservoirs Using DTS, DAS, and Surface Seismic Array," Proceedings World Geothermal Congress 2020+1, Oct. 2021 (9 pages).
Martuganova, E. et al., "Cable reverberations during wireline distributed acoustic sensing measurements: their nature and methods for elimination," Geophysical Prospecting, No. 69, pp. 1034-1054, 2021 (21 pages).
Mateeva, A., et al., "Distributed acoustic sensing for reservoir monitoring with vertical seismic profiling," Geophysical Prospecting, 2014 (14 pages).
Merry, H. et al., "Optimizing Distributed Acoustic Sensing (DAS) Acquisition: Test Well Design and Automated Data Analysis," Society of Exploration Geophysicists, SEG International Exposition and 90th Annual Meeting, pp. 520-524, 2020 (5 pages).
Pevzner, R., B., et al., "Repeat well logging using earthquake wave amplitudes measured by distributed acoustic sensors," The Leading Edge, 2020 (23 pages).
Fernandez-Ruiz, M.R. et al., "Distributed Acoustic Sensing Using Chirped-Pulse Phase-Sensitive OTDR Technology," Sensors, 19, 4368, 2019 (28 pages).
Sterling, R., et al., "State of Technology for Rehabilitation of Wastewater Collection Systems," Environmental Protection Agency, 2010 (326 pages).
Titov, A. et al., "Quantification of DAS VSP Quality: SNR vs. Log-Based Metrics," Sensors, 22, 1027, Jan. 28, 2022 (13 pages).
Titov, A., et al., "Observations and modeling of scattered waves from hydraulic fractures in a DAS VSP experiment in the Permian Basin," SEG International Exposition and Annual Meeting, 2019 (5 pages).
Willis, M. E., et al., "Understanding cable coupling artifacts in wireline-deployed DAS VSP data," SEG International Exposition and Annual Meeting, 2019 (5 pages).
Willis, M.E. et al., "Quantitative quality of distributed acoustic sensing vertical seismic profile data," CrossMark, pp. 605-609, Jul. 2016 (5 pages).
Munn, J., et al., "Novel cable coupling technique for improved shallow distributed acoustic sensor VSPs," Journal of Applied Geophysics, 2017 (8 pages).
Eaid, M., et al., "Multiparameter seismic elastic full-waveform inversion with combined geophone and shaped fiber-optic cable data," Geophysics, 2020 (16 pages).
Kazei, V., et al., "Inverting distributed acoustic sensing data using energy conservation principles," Society of Exploration Geophysicists, 2021 (10 pages).
International Search Report issued in corresponding International Application No. PCT/US2024/050332; mailed Feb. 18, 2025 (6 pages).
Written Opinion of the International Searching Authority issued in corresponding International Application No. PCT/US2024/050332; dated Feb. 18, 2025 (7 pages).

* cited by examiner

SYSTEM AND METHOD FOR DEPLOYING FIBER OPTIC CABLES WITH A CURED-IN-PLACE PIPE LINER

BACKGROUND

In the oil and gas industry, liners may be used in a well to line a wellbore. Similar to casing, liners are used to protect and reinforce the wellbore. In some instances, fiber optic cables are extended down the liner for data transmission within the wellbore to the surface. Fiber optic cables may refer to optic cables or optical fiber cables which transfer data signals in the form of light. The fiber optic cables include optical fibers within a casing. For example, optical fibers are typically individually coated with plastic layers and contained in the casing (i.e., a protective tube) suitable for the environment where the fiber optic cables will be used.

Distributed acoustic sensing (DAS) uses telecommunication or engineered fiber optic cables and turns the fiber optic cables into a dense array of single component strain or strain-rate sensors. DAS emerged into Vertical Seismic Profiling (VSP) to deliver seismic wavefield recordings along the whole well length. Moreover, fiber optic cables cemented behind casing in wells allow the fiber optic cables to record VSP during in-well operations and provide excellent data repeatability during time-lapse seismic surveys. DAS VSP applications include offshore and onshore reservoir monitoring hydraulic fracture monitoring, monitoring for carbon capture utilization, and storage (CCUS) applications, and evaluation of geothermal sites. The density of DAS channels delivers opportunity for in-place inversion of elastic properties.

However, due to the significant cost of permanent fiber installation, temporary fiber installation has become more and more widespread. The temporary fiber installation includes the installation of fiber optic cables on the wireline and disposable bare fiber installations. Despite quality degradation, such installations prove to be valuable for some applications thanks to their comparatively cheap deployment costs. Other borehole applications such as fracture monitoring at their current stage also require cementing of the fiber optic cables behind the casing which makes it prohibitively expensive to deploy fiber optic cables in every well and almost impossible to deploy fiber optic cables permanently in existing wells. However, expandable fiber optic cables do not deliver sufficient coupling for accurate VSP and strain sensing.

SUMMARY OF DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method for lining a wellbore. The method may include inserting a cured-in-place pipe liner into the wellbore; forcing the cured-in-place pipe liner against walls of the wellbore; curing the cured-in-place pipe liner; monitoring the curing of the cured-in-place pipe liner with one or more fiber optic cables embedded in the cured-in-place pipe liner; coupling the cured-in-place pipe liner to the walls of the wellbore; and continuously monitoring the wellbore with the one or more fiber optic cables.

In another aspect, embodiments disclosed herein relate to a method for lining a wellbore. The method may include inverting a cured-in-place pipe liner into the wellbore; forcing the cured-in-place pipe liner against walls of the wellbore; curing the cured-in-place pipe liner; monitoring the curing of the cured-in-place pipe liner with one or more fiber optic cables embedded in the cured-in-place pipe liner; coupling the cured-in-place pipe liner to the walls of the wellbore; and continuously monitoring the wellbore with the one or more fiber optic cables.

In yet another aspect, embodiments disclosed herein relate to a system that may include a wellbore extending a first depth into a formation; a cured-in-place pipe liner coupled to walls of the wellbore; and one or more fiber optic cables embedded in the cured-in-place pipe liner to monitor a curing of the cured-in-place pipe liner and record well data. The one or more fiber optic cables may be used to continuously monitor the wellbore during a method for lining the wellbore is performed. The method for lining the wellbore may include inserting the cured-in-place pipe liner into the wellbore; forcing the cured-in-place pipe liner against walls of the wellbore; curing the cured-in-place pipe liner; monitoring the curing of the cured-in-place pipe liner with the one or more fiber optic cables embedded in the cured-in-place pipe liner; and coupling the cured-in-place pipe liner to the walls of the wellbore.

Any combinations of the various embodiments and implementations disclosed herein can be used in a further embodiment, consistent with the disclosure. Other aspects and advantages of the invention will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, shapes of the elements as drawn are not necessarily intended to convey any information regarding the actual shape of the elements and have been solely selected for ease of recognition in the drawing.

DETAILED DESCRIPTION

Figure 1:
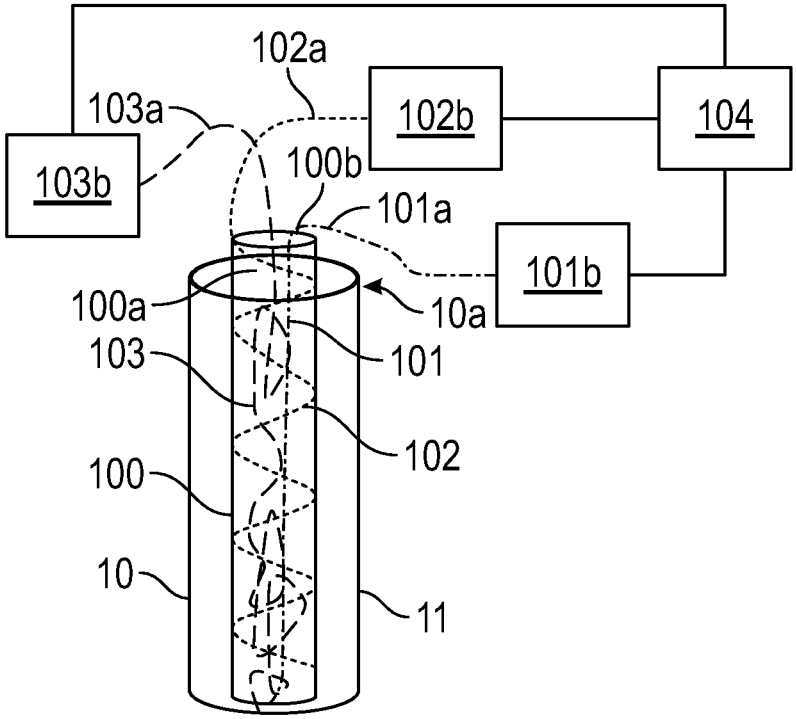
FIG. 1 illustrates a block diagram of a liner with one or more fiber optic cables in accordance with one or more embodiments of the present disclosure.

Embodiments of the present disclosure are described below in detail with reference to the accompanying figures. However, one skilled in the relevant art will recognize that implementations and embodiments may be practiced without one or more of these specific details, or with other methods, components, materials, and so forth. For the sake of continuity, and in the interest of conciseness, same or similar reference characters may be used for same or similar objects in multiple figures. As used herein, the term "coupled" or "coupled to" or "connected" or "connected to" "attached" or "attached to" may indicate establishing either a direct or indirect connection and is not limited to either unless expressly referenced as such.

As used herein, fluids may refer to slurries, liquids, gases, and/or mixtures thereof. It is to be further understood that the various embodiments described herein may be used in various stages of a well (land and/or offshore), such as rig site preparation, drilling, completion, abandonment etc., and in other environments, such as work-over rigs, fracking installation, well-testing installation, oil and gas production installation, without departing from the scope of the present disclosure. Further, embodiments disclosed herein are described with terms designating orientation in reference to a vertical wellbore, but any terms designating orientation should not be deemed to limit the scope of the disclosure. For example, embodiments of the disclosure may be made with reference to a horizontal wellbore. It is to be further understood that the various embodiments described herein may be used in various orientations, such as inclined, inverted, horizontal, vertical, etc., and in other environments, such as sub-sea, without departing from the scope of the present disclosure. The embodiments are described merely as examples of useful applications, which are not limited to any specific details of the embodiments herein.

In one or more embodiments, the present disclosure may be directed to systems and methods for deploying fiber optic cables when installing a liner in a well. More specifically, embodiments disclosed herein are directed to using fiber optic cables embedded into or adjacent to the liner to couple the fiber optic cables to the well. Additionally, the liner is a cured-in-place pipe (CIPP) liner to set the liner against a wellbore of the well. While CIPP procedures are conducted and after the liner is installed in the well, the fiber optic cables are used to record well data via distributed acoustic sensing (DAS) and distributed temperature sensing (DTS). In some embodiment, the CIPP liner may be inverted within the wellbore. Accordingly, the systems and methods disclosed herein provide improved coupled of the CIPP liner with the fiber optic cables to the wellbore. In one or more embodiments of a method for using the CIPP liner with the fiber optic cables results in achieving continuous well monitoring without the need for human intervention and a reduction in operational costs associated with conventional methods using fiber optic cables for well monitoring. Overall, the CIPP liner with the fiber optic cables as described herein may reduce product engineering, reduction of assembly time, hardware cost reduction, and weight and envelope reduction.

Figure 2:
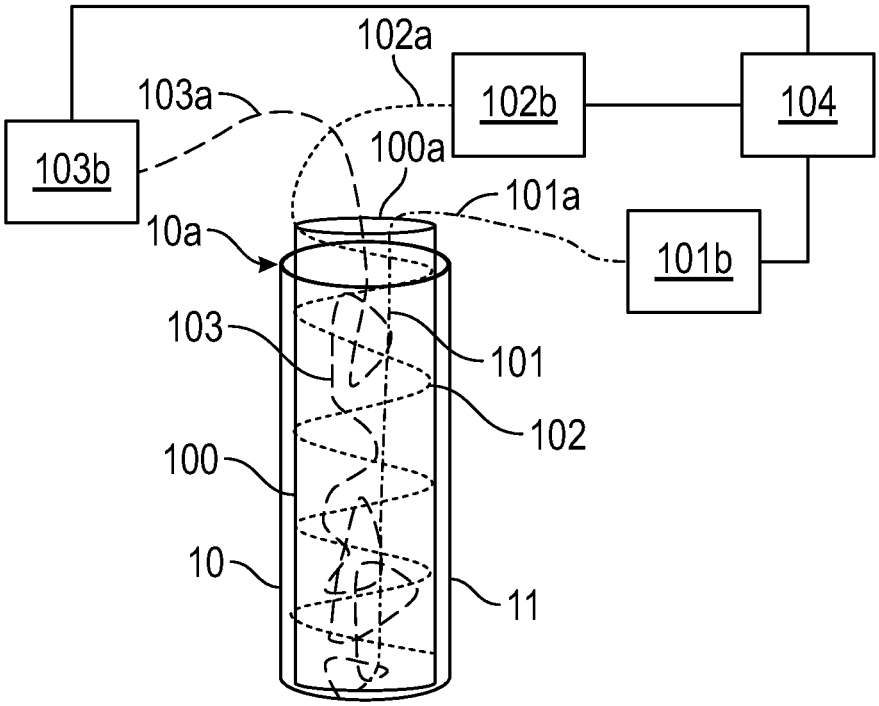
FIG. 2 illustrates a block diagram of the liner of FIG. 1 cured against a wellbore in accordance with one or more embodiments of the present disclosure.

Now referring to FIGS. 1 and 2, in one or more embodiments, a block diagram of a cured-in-place pipe (CIPP) liner 100 with at least one fiber optic cable (101-103) is illustrated within a wellbore 10. The wellbore 10 is formed by drilling into a formation to define a conduit for conveying fluids. Additionally, walls 11 of the wellbore 10 are delimited by the formation itself. While the wellbore 10 is shown in a vertical orientation, this is from example purposes only and the wellbore 10 may include horizontal sections. Further, only a portion of the wellbore 10 is illustrated for simplicity purposes only. In some embodiments, a casing string may be cemented against the wellbore 10 such that the CIPP liner 100 will be cured against the casing string instead of the wellbore 10.

In one or more embodiments, the CIPP liner 100 is a tube 100*a* impregnated or embedded with resin. The tube 100*a* of the CIPP liner 100 may be made from various materials such as felt, fiberglass, carbon fiber, textile (e.g., cellulosics (cotton, viscose, etc.), polyester, polyamide, elastomer (e.g. Lycra)), polyethylene (PE), composite materials, or a combination thereof. In some embodiments, the material of the tube 100*a* may be fiber-reinforced or woven. Additionally, the resin may be polyester resin, vinyl ester resin, epoxy resin, a combination thereof, or any type of thermoset resin. Furthermore, the resin may include a filler such as inert filler to increase stiffness when the resin is cured.

In some embodiments, to impregnate or embed the resin within the tube 100*a* of the CIPP liner 100, a wet-out process may be conducted. For example, the resin may be first pumped into the center of the tube 100*a*. Then the resin migrates, under vacuum, from an inside surface of the tube 100*a* to an outer surface of the tube 100*a* to impregnate or be embedded over the length of the tube 100*a*. Additionally, the inside surface of the tube 100*a* and the outer surface of the tube 100*a* may be coated with a thermoplastic polymer, such as a thermoplastic polyolefin (TPO) or thermoplastic polyurethane (TPU), to hold the resin in the tube 100*a* during the wet-out process and to prevent losing resin during installation of the CIPP liner 100.

During the wet-out process, the fiber optic cables (101-103) may be embedded in the CIPP liner 100. For example, the fiber optic cables (101-103) may be attached to or woven into the tube 100*a* such that when the resin impregnates the tube 100*a*, the fiber optic cables (101-103) become embedded into the tube 100*a*. In some embodiments, the fiber optic cables (101-103) may first be attached to a mat and the mat may then be attached to the tube 100*a*. The mat may be a flat sheet made from felt, fiberglass, carbon fiber, textile (e.g., cellulosics (cotton, viscose, etc.), polyester, polyamide, elastomer (e.g. Lycra)), polyethylene (PE), composite, or a combination thereof. Alternatively, the fiber optic cables (101-103) may first be placed loosely hanging in the wellbore 10, and then, the CIPP liner 100 is placed in the wellbore to press the fiber optic cables (101-103) against the walls 11 of the wellbore 10.

In one or more embodiments, the fiber optic cables (101-103) may be arranged in various orientations running down the tube 100*a*. For example, a first fiber optic cable 101 may be arranged in a liner orientation such that the first fiber optic cable 101 runs axially down a length of the tube 100*a* in a relatively straight line. A second fiber optic cable 102 may be arranged in an oscillating orientation such that the second fiber optic cable 102 runs in a sinusoidal line down the length of the tube 100*a*. A third fiber optic cable 103 may be arranged in a random orientation such that the third fiber optic cable 103 may run in various directions and shapes down the length of the tube 100*a*. For example, the third fiber optic cable 103 may be arranged to have various circular loops, curves, and straight lines down the length of the tube 100*a*. Additionally, the fiber optic cables (101-103) may be oriented in different configurations such as helical, multi-sinusoidal, straight, and a combination thereof to record different components of the strain tensor. By having the first fiber optic cable 101, the second fiber optic cable 102, and the third fiber optic cable 103 run down the tube 100*a* in various orientations, the fiber optic cables (101-103) provide data coverage over the length and circumference of the CIPP liner 100 to optimize distributed acoustic sensing (DAS) and distributed temperature sensing (DTS). It is further envisioned that each fiber optic cable (101-103) may be dedicated for a mode in DAS or DTS. For example, the first fiber optic cable 101 and the third fiber optic cable 103 may be used for the DAS mode while the second fiber optic cable 102 may be used for the DTS mode. As the second fiber optic cable 102 may be used for the DTS mode, the second fiber optic cable 102 may have a helical configuration to cover an area of fiber more uniformly. In some embodiments, all the fiber optic cables (101-103) may be used for both in the DAS mode and the DTS mode.

The fiber optic cables (101-103) also extend out of an end of the tube 100*a*. For example, a portion (101*a*-103*a*) of each fiber optic cable (101-103) extends axially outward from an end surface 100*b* of the tube 100*a*. Additionally, the end surface 100*b* of the tube 100*a* may be positioned at a top end 10*a* of the wellbore 10 such that the portion (101*a*-103*a*) of each fiber optic cable (101-103) is not in the wellbore 10. By having the portion (101*a*-103*a*) of each fiber optic cable (101-103) not in the wellbore 10, a corresponding measurement unit or data acquisition unit (101*a*-103*a*) may be connected to each fiber optic cable (101-103). In some embodiments, the fiber optic cables (101-103) may be connected to a single data acquisition unit. The data acquisition units (101*a*-103*a*) may be fiber optical interrogators (e.g., optoelectronic instrument) to allow static and dynamic monitoring applications. For example, if the fiber optic cables (101-103) include fiber Bragg grating (FBG) in a core, when a light is launched through the fiber optic cables (101-103), a portion of the light will be reflected back to the fiber optical interrogators from the FBG, with the rest of the light passing through the FBG. Based on the received reflected light, the fiber optical interrogators may record and determine various parameters, such as temperature and strain, during the DAS and the DTS.

In some embodiments, a control system 104 may be connected to each data acquisition unit (101*a*-103*a*). In some embodiments, the data acquisition units (101*a*-103*a*) may be incorporated into the control system 104. The control system 104 may include hardware and/or software that monitors and/or operates equipment in communication with the wellbore 10. In particular, the control system 141 may be coupled to the data acquisition units (101*a*-103*a*) to collect data throughout the wellbore 10 from the fiber optic cables (101-103). In some embodiments, the control system 104 may include a programmable logic controller that may control data transmission through the fiber optic cables (101-103), equipment for inflating or curing the CIPP liner 100, and/or various hardware components throughout the wellbore 10. For example, the control system 104 may be used to place each of the fiber optic cable (101-103) in either DAS mode or DTS mode. Thus, a programmable logic controller may be a ruggedized computer system with functionality to withstand vibrations, extreme temperatures, wet conditions, and/or dusty conditions, such as those around well site (e.g., a completion well or drilling rig).

In one or more embodiments, the control system 104 may include functionality for presenting data and/or receiving inputs from a user regarding well data recorded by the fiber optic cables. For example, the control system 104 may be a user device such as personal computers, smartphones, and any other devices coupled to a network that obtain inputs from one or more users, e.g., by providing a graphical user interface (GUI) for presenting data and/or receiving control commands for conducting operations at the wellbore 10. In some embodiments, data is transmitted via a network element coupled to the control system 104. The network element may refer to various hardware components within a network, including switches, routers, hubs or any other logical entities for uniting one or more physical devices on the network. For example, a network element and/or the control system 104 may be a computing system similar to the computing system described in FIG. 19, and the accompanying description.

As shown in FIG. 1, the CIPP liner 100 is inserted into the wellbore 10. For example, from the top end 10*a* of the wellbore 10, the CIPP liner 100 is lowered into the wellbore 10. In some embodiments, a weight or cable (not shown) is attached to an end of the CIPP liner to pull the CIPP liner down the wellbore. For example, the end of the CIPP liner may be attached to an end of a wireline column (not shown) submerging into the well. Alternatively, the end of the CIPP liner may be attached to a retrievable robot (not shown) that stays in the wellbore during the inflation and curing. The retrievable robot may be rolled out after the CIPP liner is inflated and cured in place. The CIPP liner 100 extends down a predetermined length into the wellbore 10 while the CIPP liner 100 is flexible and in a deflated state. The predetermined length may be a length of the wellbore 10 that is required to be lined.

As shown in FIG. 2, with the CIPP liner 100 in the wellbore 10, the CIPP liner 100 is pressed against the walls 11 of the wellbore 10. For example, fluid (e.g., water) or gas (compressed air) may be pumped into the CIPP liner 100 to inflate the CIPP liner 100. In the inflated state, the CIPP liner 100 will expand radially outward towards the walls 11 of the wellbore 10. The fluid or gas will continue to be pumped into the CIPP liner 100 until the CIPP liner 100 is pressed against the walls 11 of the wellbore 10. As the diameter of the wellbore 10 is known, a predetermined volume of fluid or gas pumped into the CIPP liner 100 may correspond to volume which expands the CIPP liner 100 entirely against the walls 11 of the wellbore 10. In some embodiments, an internal hose (not shown) may be used to inflate the CIPP liner 100 within the wellbore 10. Further, the internal hose may be used to hold the CIPP liner 100 under pressure against the wellbore 10 until the CIPP liner 100 is cured. Additionally, the fiber optic cables (101-103) may also be used to confirm that the CIPP liner 100 has moved from the deflated state to the inflated state and is entirely against the walls 11 of the wellbore 10.

Once the CIPP liner 100 is against the walls 11 of the wellbore 10, the CIPP liner 100 will then undergo a chemical process called curing to harden the CIPP liner 100 into a hard liner and couple the fiber optic cables (101-103) with the wellbore 10. For example, the resin within the tube 100*a* is heated to cure and make the tube 100*a* a hard pipe. It is further envisioned that due to a wellhead of the wellbore being in a ventilated or outdoor environment, fumes from heating the resin may not accumulate to prevent workers from being exposed to a plume of resin material. To heat the resin, various curing methods may be used. For example, hot water, steam, or ultraviolet light may be used to raise the temperature of the CIPP liner 100 to conduct the curing process. In some embodiments, the fluid or gas used to inflate the CIPP liner 100 may be heated to start and complete the curing process. When using ultraviolet light to heat the resin, ultra-violet lamps are pulled through the CIPP liner 100 to heat the resin. Alternatively, ambient curing may be used such that the CIPP liner 100 cures by itself based on the type of resin used which begins to cure once mixed. However, in the ambient curing operations, the CIPP liner 100 must be installed in a timely manner to avoid hardening before contacting the wellbore 10.

In one or more embodiments, the fiber optic cables (101-103) are utilized for monitoring the curing process. To monitor the curing process, at least one of the fiber optic cables (101-103) may be placed in DTS mode to monitor the temperature in the CIPP liner 100 during curing. For example, the second fiber optic cable 102 may be placed in DTS mode to continuously monitor the temperature along the entire length of the CIPP liner 100. In DTS mode, the second fiber optic cable 102 continuously monitors the temperature during curing to confirm a more complete cure throughout the length of the CIPP liner 100. Additionally, at least one of the fiber optic cables (101-103) may be placed in DAS mode to monitor a coupling between the CIPP liner 100 and the wellbore 10. For example, the first fiber optic cable 101 and the third fiber optic cable 103 may be placed in DAS mode to continuously monitor vibrations along the entire length of the CIPP liner 100. In DAS mode, the first fiber optic cable 101 and the third fiber optic cable 103 can confirm that there is sufficient coupling between the CIPP liner 100 and the walls 11 of the wellbore 10. Additionally, the curing process will also attach the fiber optic cables (101-103) to wellbore 10 to avoid static strain and tension from the CIPP liner 100. In some embodiments, once attached to the wellbore 10, the fiber optic cables (101-103) may be calibrated for static strain and tension from the CIPP liner 100. Overall, the fiber optic cables (101-103) may be used to monitor various parameters, such as, seismic, strain, and temperature measurements, during the installation and curing of the CIPP liner 100. This results in a fully cured, leak-free CIPP liner 100 coupled against the wellbore 10. It is further envisioned that after the CIPP liner 100 is coupled against the wellbore 10, the fiber optic cables (101-103) may also be used to record data during wellbore operations such as drilling, completions, and any other downhole operations.

Figure 3:
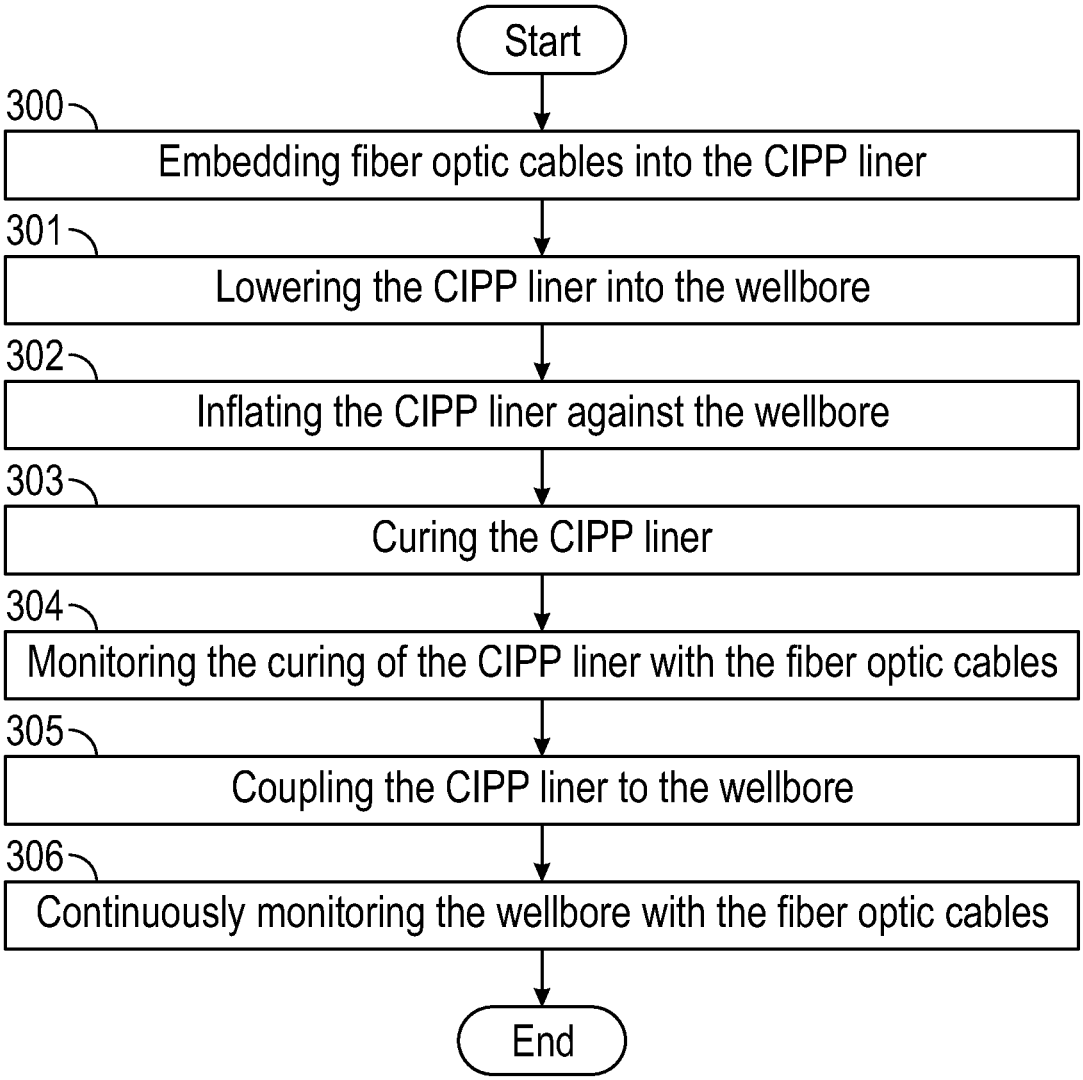
FIG. 3 illustrates a flowchart in accordance with one or more embodiments of the present disclosure.

Now referring to FIG. 3, a flowchart showing a method of installing the CIPP liner 100 of FIGS. 1 and 2 is illustrated. One or more steps in FIG. 3 may be performed by one or more components (e.g., a computing system coupled to a controller in communication with the CIPP liner 100). For example, a non-transitory computer readable medium may store instructions on a memory coupled to a processor such that the instructions include functionality for installing the CIPP liner 100. While the various blocks in FIG. 3 are presented and described sequentially, one of ordinary skill in the art will appreciate that some or all of the steps may be executed in different orders, may be combined or omitted; and some or all of the steps may be executed in parallel. Furthermore, the steps may be performed actively or passively.

In Step 300, the fiber optic cables are embedded in the CIPP liner. For example, the fiber optic cables may be attached to or woven into the tube of the CIPP liner. During the wet-out process of the tube, the resin impregnates the tube which will also embed the fiber optic cables into the tube. In some embodiments, the fiber optic cables may first be attached to a mat and the mat may then be attached to the tube. Similarly, once the resin impregnates the tube, the mat will be fixed to the tube.

Additionally, the fiber optic cables may be attached to or woven into the tube in various orientations running down the tube. For example, a first fiber optic cable may be arranged in a liner orientation such that the first fiber optic cable runs axially down a length of the tube in a relatively straight line. A second fiber optic cable may be arranged in an oscillating orientation such that the second fiber optic cable runs in a sinusoidal line down the length of the tube. A third fiber optic cable may be arranged in a random orientation such that the third fiber optic cable may run in various directions and shapes down the length of the tube. For example, the third fiber optic cable may be arranged to have various circular loops, curves, and straight lines down the length of the tube.

In Step 301, the CIPP liner is lowered into the wellbore. For example, a weight or cable is attached to an end of the CIPP liner to pull the CIPP liner down the wellbore. The CIPP liner extends down a predetermined length into the wellbore. The predetermined length may be a length of the wellbore required to be lined. Additionally, when the CIPP liner is lowered into the wellbore, the CIPP liner is flexible and in a deflated state. Furthermore, when the CIPP liner is within wellbore, a top end of the fiber optic cables may be connected to fiber optical interrogators at a surface above the wellbore.

In Step 302, the CIPP liner is inflated to be against the wellbore. For example, fluid (e.g., water) or gas (compressed air) may be pumped into the CIPP liner to inflate the CIPP liner. As the CIPP liner is inflated, the CIPP liner will expand radially outward towards the walls of the wellbore. A predetermined volume of fluid or gas will be pumped into the CIPP liner until the CIPP liner is pressed against the walls of the wellbore. The predetermined volume of fluid or gas may correspond to volume which expands the CIPP liner entirely against the walls of the wellbore. Additionally, to confirm that the CIPP liner has been pressed entirely against the walls of the wellbore, the fiber optic cables may be utilized. For example, the fiber optic cables may be placed in distributed acoustic sensing (DAS) mode to monitor seismic variations and strain occurring on the CIPP liner. If the seismic variations and strain have met predetermined thresholds, the CIPP liner has been fully pressed against the walls of the wellbore. However, if the seismic variations and strain has not met predetermined thresholds, an alert may be sent to continue pumping the fluid or gas until the predetermined thresholds have been met.

In Step 303, with the CIPP liner against the walls of the wellbore, the CIPP liner will be cured to harden the CIPP liner into a hard liner. For example, the resin within the tube of the CIPP liner is heated to harden the tube into a hard pipe. To heat the resin, various curing methods may be used. For example, hot water, steam, or ultraviolet light may be used to raise the temperature of the CIPP liner to conduct the curing of the resin. In some embodiments, the fluid or gas used to inflate the CIPP liner may be heated to start and complete the curing process.

In step 304, during the curing process, the fiber optic cables monitor the curing of the CIPP liner. For example, at least one of the fiber optic cables is placed in distributed temperature sensing (DTS) mode to monitor a temperature during curing. In DTS mode, the at least one fiber optic cable continuously monitors the temperature along the entire length of the CIPP liner. Based on the recorded temperature, the at least one fiber optic cable can confirm a more complete curing cure throughout the length of the CIPP line. For example, if the recorded temperature has reached a predetermined temperature threshold for a predetermined time, the CIPP liner has been fully cured to turn the CIPP liner into a hard pipe. The predetermined temperature threshold is a temperature required to start curing process (e.g., heating the resin to chemically react). Additionally, the predetermined time is a period of time at which the resin must be heated for at the predetermined temperature threshold to fully cure the CIPP liner. However, if the recorded temperature has not met predetermined temperature threshold, an alert may be sent to continue heating the resin until the predetermined temperature threshold have been met. It is further envisioned that after the predetermined time, the at least one fiber optic cable may be used to record a temperature to confirm that the CIPP liner has been harden. For example, if the recorded temperature after the predetermined time does not meet a predetermined temperature of a harden CIPP liner, an alert may be sent to continue heating the resin until the predetermined temperature is reached.

In Step 305, once the CIPP liner is cured, the CIPP liner is coupled to the wellbore. For example, as the resin cures, the CIPP liner affixes to the walls of the wellbore. This also allows the fiber optic cables to be couples to the wellbore. Additionally, at least one of the fiber optic cables may be placed in DAS mode to monitor a coupling between the CIPP liner and the wellbore. For example, the at least one of the fiber optic cables continuously monitors vibrations and strain along the entire length of the CIPP liner to confirm that there is sufficient coupling between the CIPP liner and the walls of the wellbore.

In Step 306, with the CIPP liner coupled to the wellbore, the fiber optic cables continuously monitor the wellbore. For example, the fiber optic cables record well data during wellbore operations such as drilling, completions, and any other downhole operations.

Now referring FIGS. 4-7, in one or more embodiments, FIGS. 4-7 illustrate a system of implementing the method described in the flowchart of FIG. 3 using the CIPP liner 100 of FIGS. 1 and 2 at a well site 400.

Figure 4:
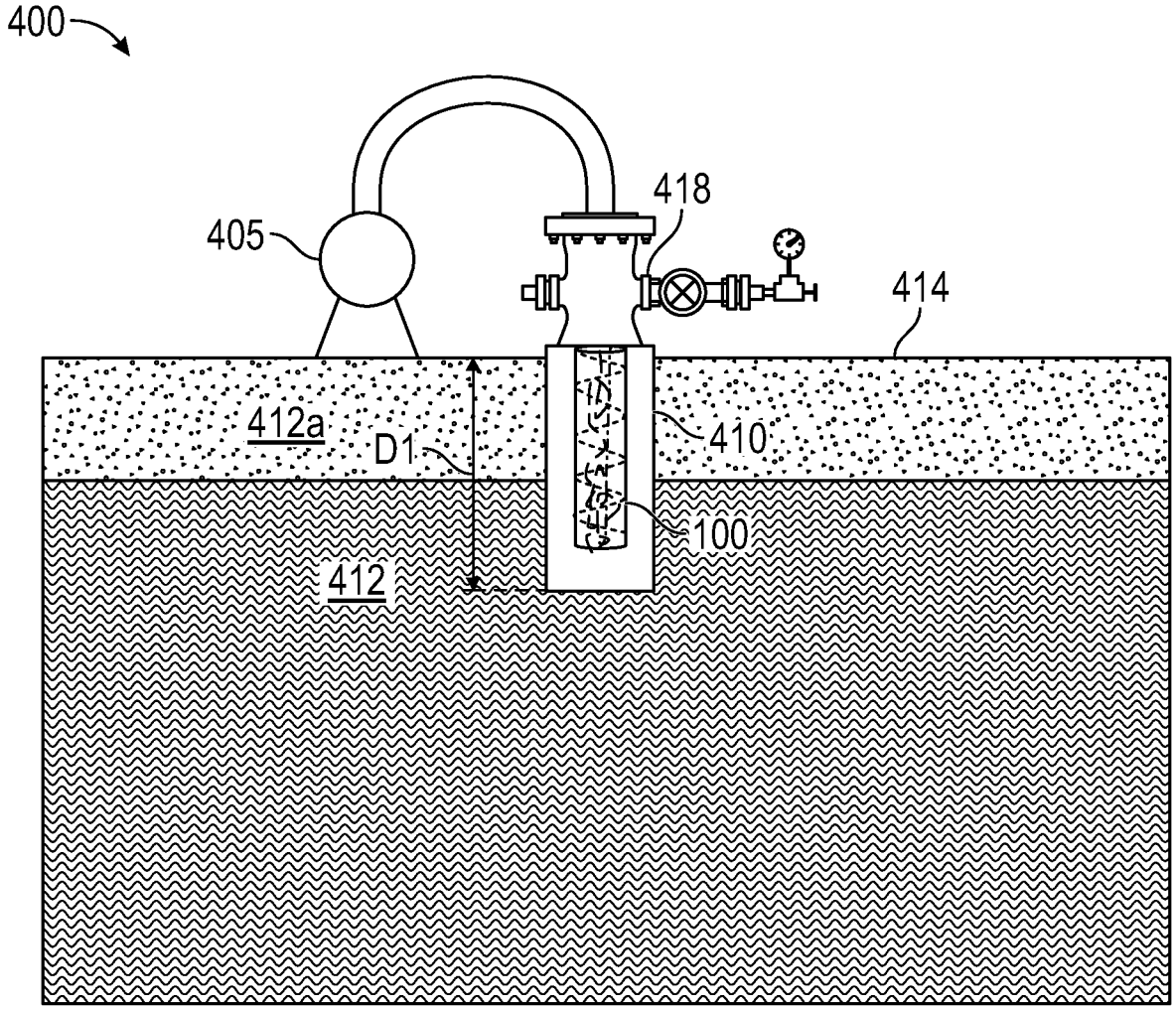
FIGS. 4-10 illustrate implementing the flowchart of FIG. 3 at a well site in accordance with one or more embodiments of the present disclosure.

Turning to FIG. 4, in one or more embodiments, an example of a well site 400 is illustrated. A wellbore 410 is formed by drilling into the formation 412 from a surface 414. Initially, the wellbore 410 is drilled a first depth D1 into the formation 412. This first depth D1 may correspond to shallow section of wellbore 410 drilled in unconsolidated formation 412*a* of the formation 412. To support the wellbore 410 in unconsolidated formation 412*a* of the formation 412, typically, a conductor casing string is installed and cemented to the wellbore 410. However, before the conductor casing string is installed, the CIPP liner 100 is installed in the wellbore 410.

In one or embodiments, the CIPP liner 100 is inserted into the wellbore 410. For example, a liner spool 405 unspools the CIPP liner 100 into a wellhead 418 installed on top of the wellbore 410 at the surface 414. From the wellhead 418, the CIPP liner 100 is lowered into the wellbore 410. Initially, the CIPP liner 100 is in a deflated state to allow the CIPP liner 100 to be more easily inserted into the wellbore 410.

Figure 5:
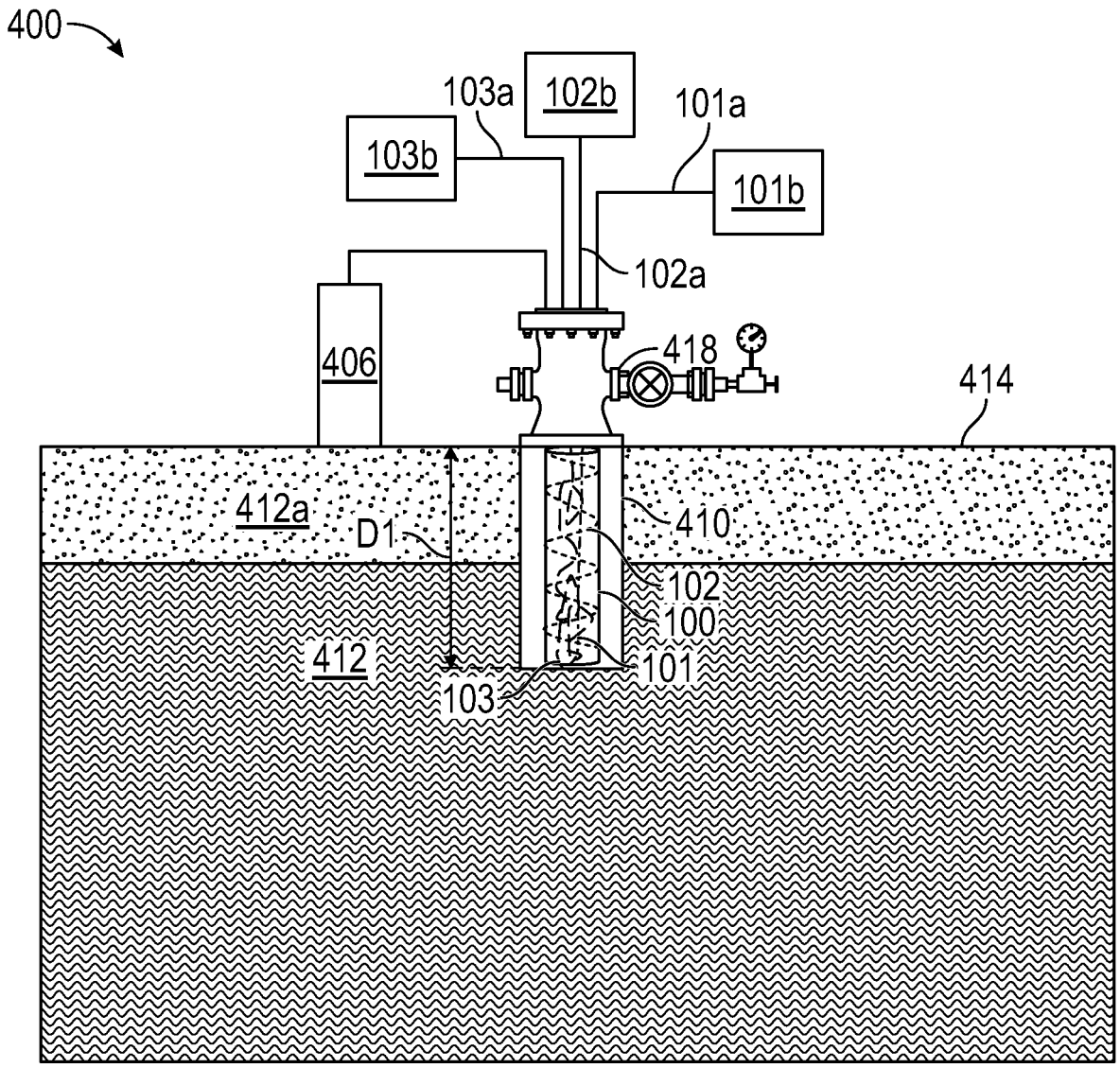

As shown in FIG. 5, once the CIPP liner 100 has been lowered a length into the wellbore equal to the first depth D1, the portion (101*a*-103*a*) of each fiber optic cable (101-103) not in the wellbore 410 is connected to the fiber optical interrogators (101*a*-103*a*) at the surface 414. Additionally, a pump 406 is attached to the wellhead 418 to inflate the CIPP liner 100.

Figure 6:
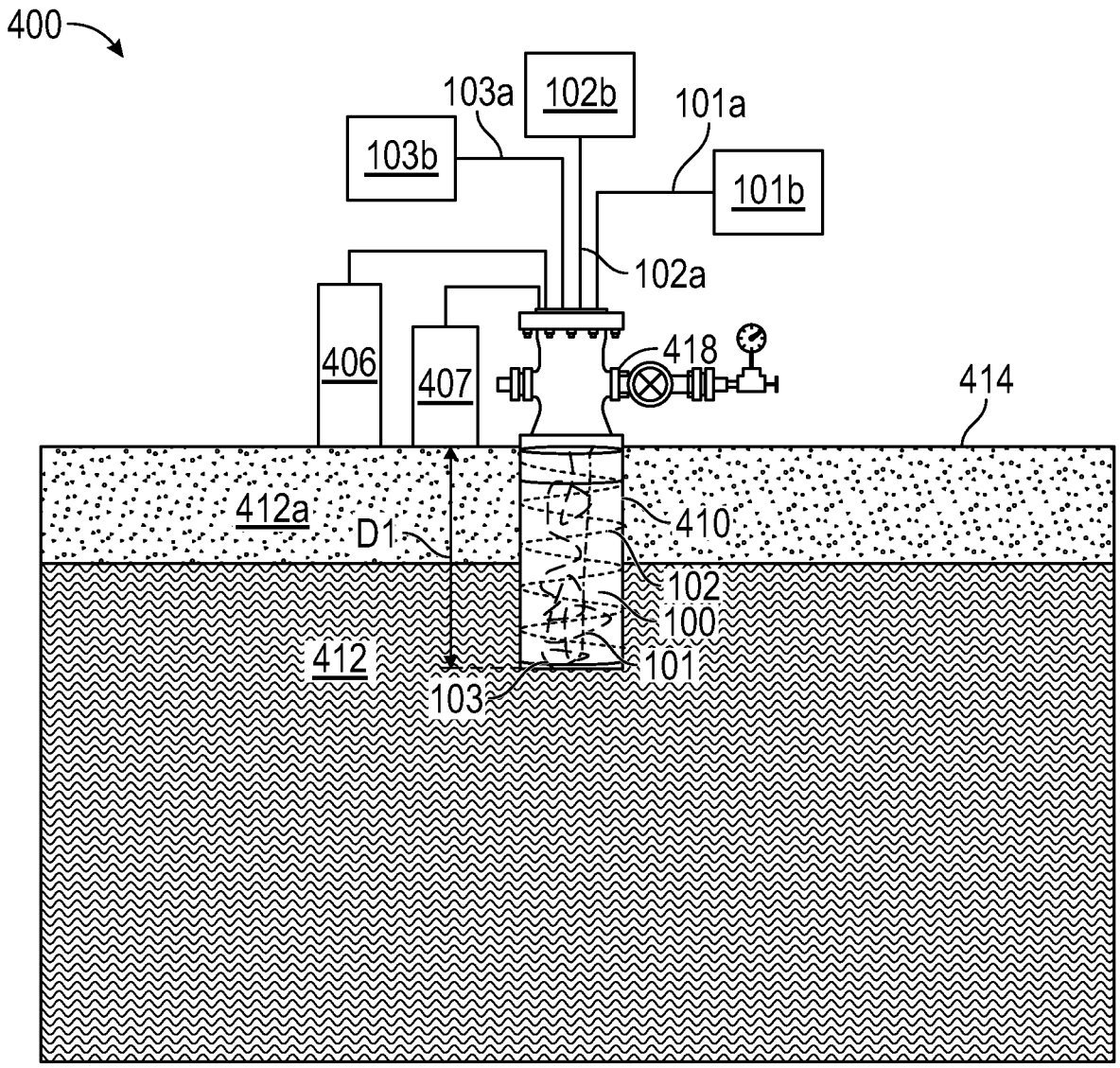

Turning to FIG. 6, the CIPP liner 100 is inflated to press against the wellbore 410. For example, the pumps 406 pumps fluid (e.g., water) or gas (compressed air) into the CIPP liner 100 to inflate the CIPP liner 100. In the inflated state, the CIPP liner 100 will expand radially outward towards the wellbore 410. The fluid or gas will continue to be pumped into the CIPP liner 100 until the CIPP liner 100 is pressed against the wellbore 410. Additionally, the fiber optic cables (101-103) may also be used to confirm that the CIPP liner 100 has moved from the deflated state to the inflated state and is entirely against the wellbore 410. For example, at least one of the fiber optic cables (101-103) may be switched to DAS mode to measure vibrations which correspond to contacting the wellbore 410.

Once the CIPP liner 100 is pressed against the wellbore 410, the CIPP liner 100 will be cured. For example, a heater 407 coupled to the wellhead 418 heats the resin within the CIPP liner 100 to harden the CIPP liner 100 into a hard pipe. In some embodiments, the heater 407 may heat the fluid or gas from the pump 406 to start and complete the curing process. Alternatively, the heater 407 may be an ultra-violet lamp that is pulled through the CIPP liner 100 to heat the resin. As described above, the fiber optic cables (101-103) are utilized for monitoring the curing process. Once the CIPP liner 100 is cured, the CIPP liner 100 coupled to the wellbore 410. For example, the CIPP liner 100 is turned into a hard pipe affixed to the wellbore 410.

Figure 7:
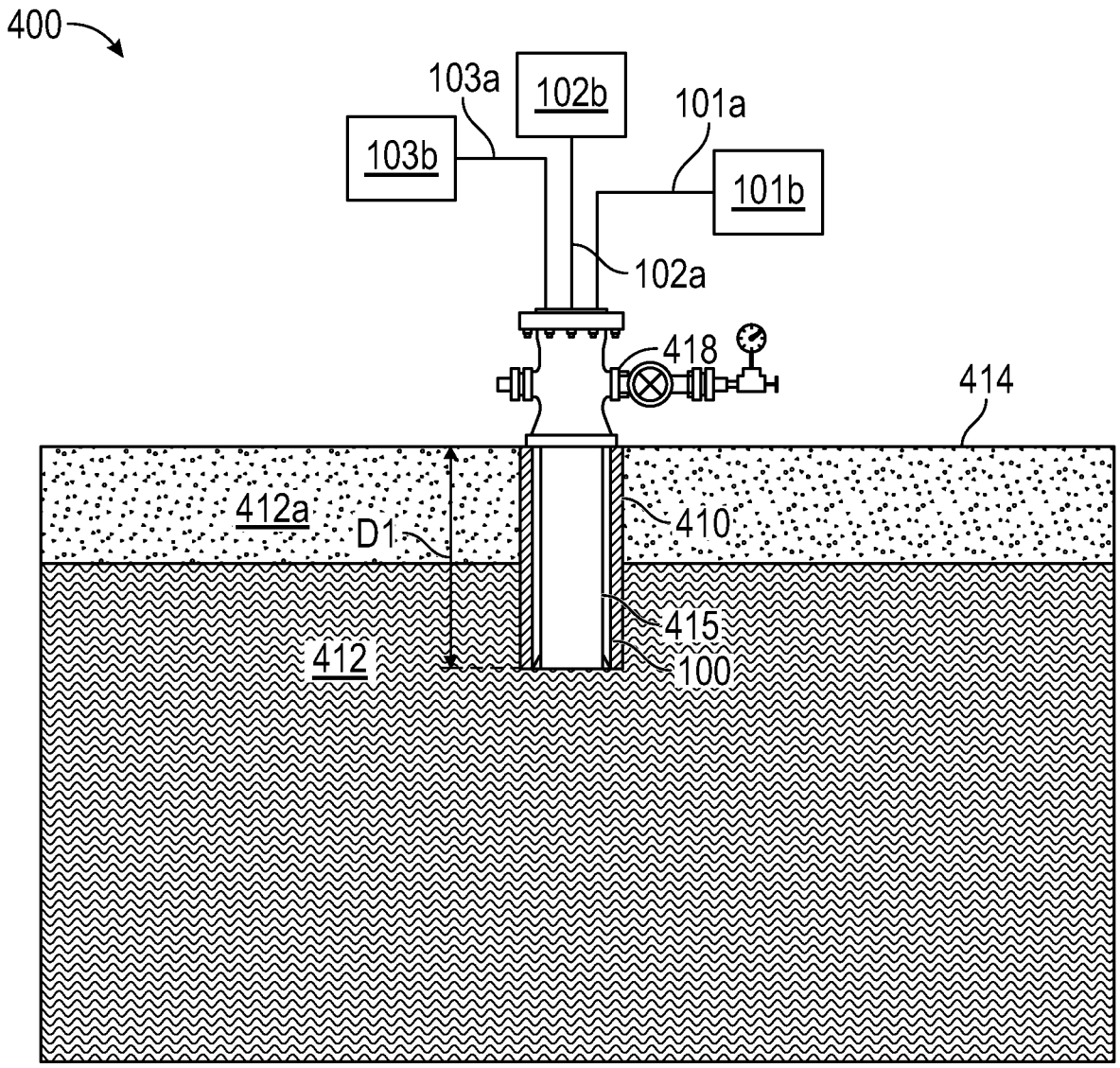

As shown in FIG. 7, with the CIPP liner 100 coupled to the wellbore 410, a conductor casing string 415 is lowered into the wellbore 410. The conductor casing string 415 may be a large-diameter casing that protects shallow formations from contamination by drilling fluid and helps prevent washouts or cave-ins involving unconsolidated topsoils and sediments in the unconsolidated formation 412*a*. Additionally, the conductor casing string 415 undergoes a cement operation. For example, the conductor casing string 415 is cemented with a cement slurry to the CIPP liner 100. It is further envisioned that the fiber optic cables (101-103) in the CIPP liner 100 may be used to monitor the cement operations on the conductor casing string 415. With the conductor casing string 415 cemented, drilling operations may be conducted to further drill wellbore 410 into the formation 412 to reach a reservoir.

Figure 8:
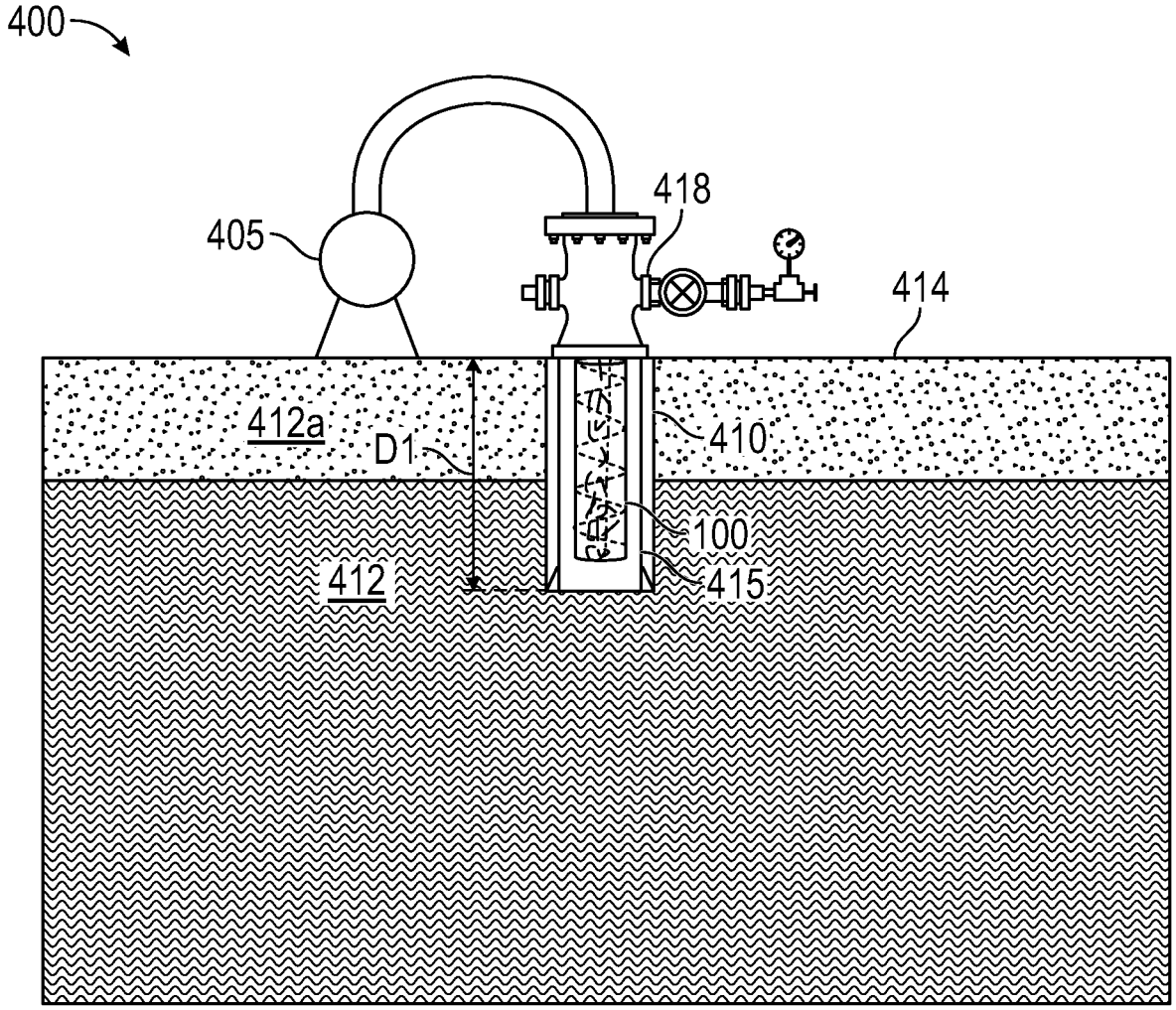
Figure 9:
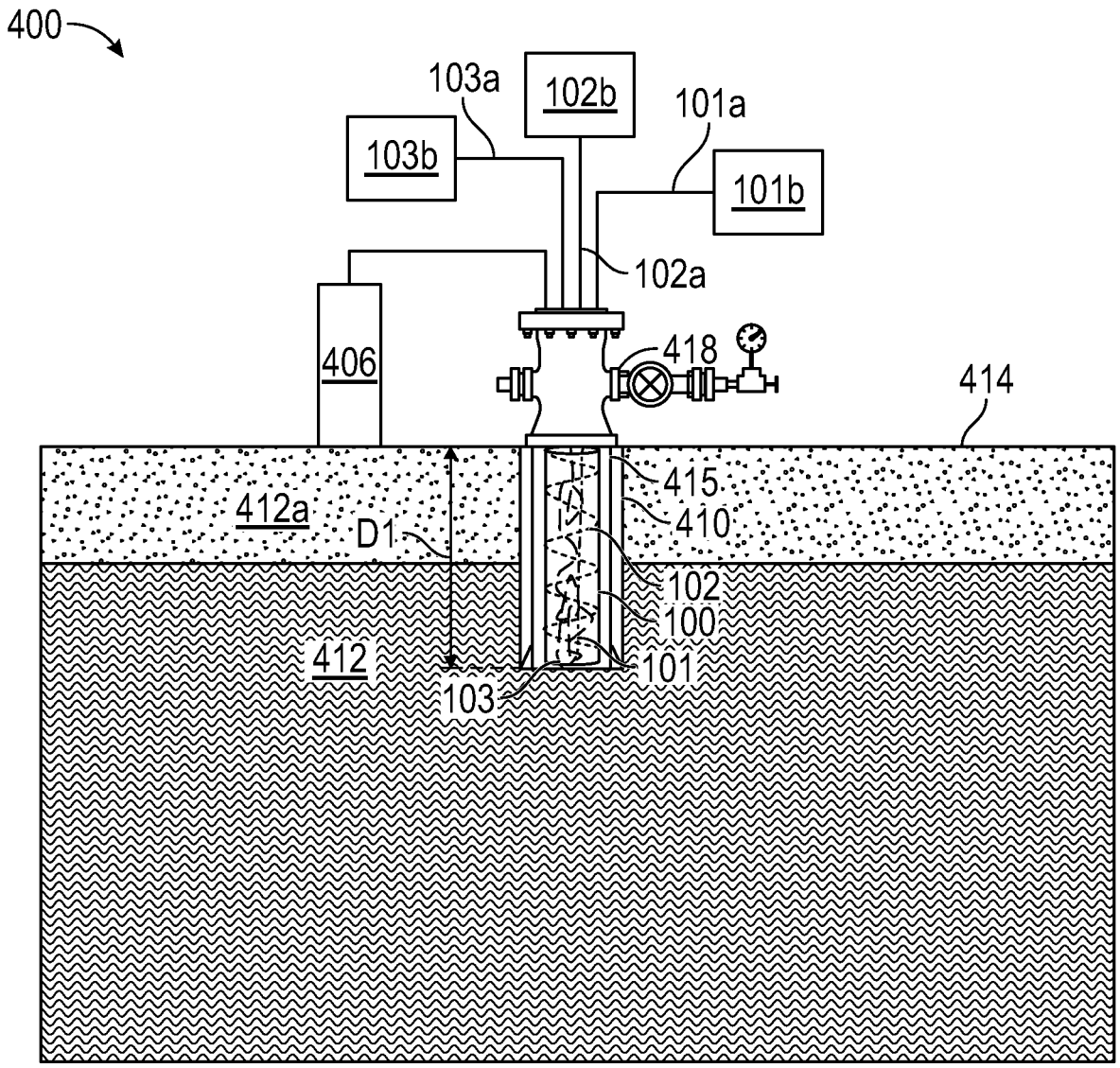
Figure 10:
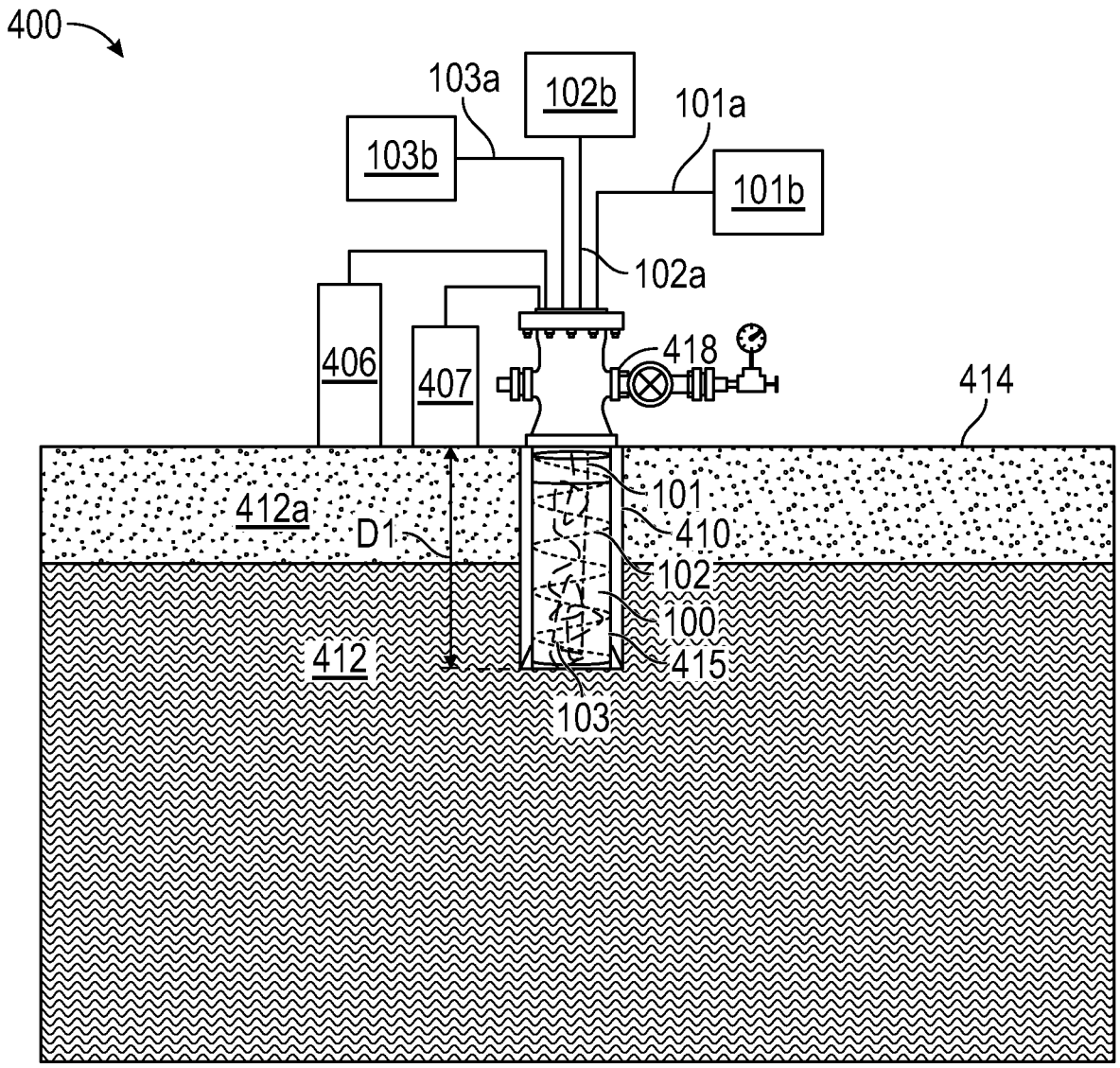

Now referring to FIGS. 8-10, another embodiment of installing the CIPP liner 100 at the well site 400 according to embodiments herein is illustrated, where like numerals represent like parts. The embodiment of FIGS. 8-10 is similar to that of the embodiment of FIGS. 4-6. However, instead of installing the CIPP liner 100 first, the conductor casing string 415 may be lowered and cemented against the wellbore 410. After the conductor casing string 415 is cemented, the CIPP liner 100 is lowered into the wellbore 410 and inflated against the conductor casing string 415.

Figure 11:
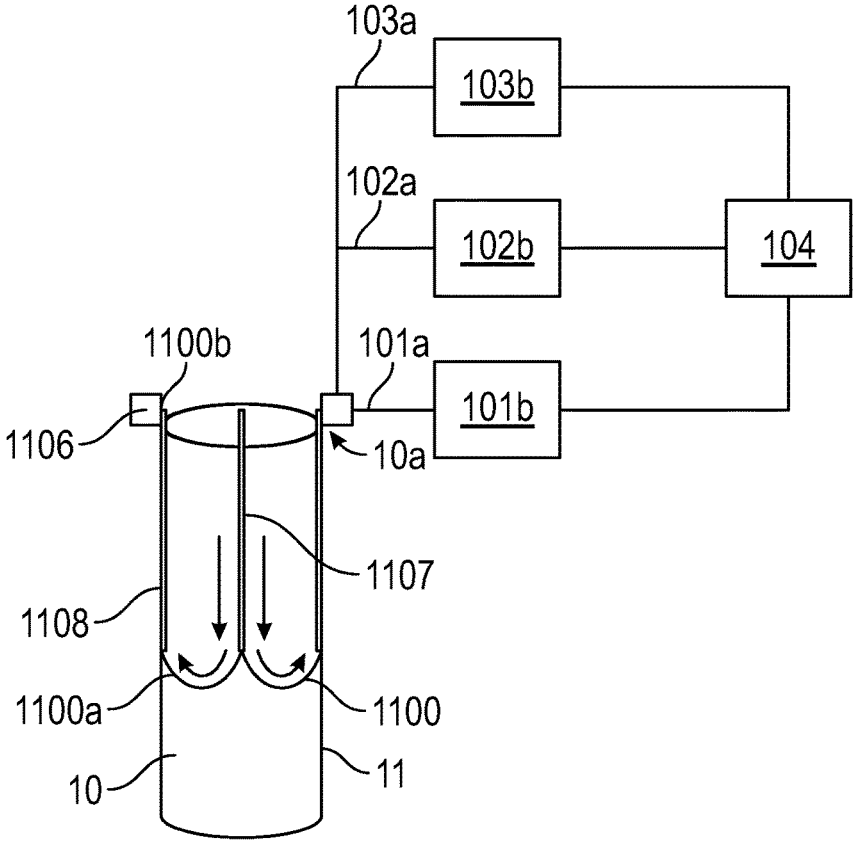
FIG. 11 illustrates a block diagram of an inverted liner with one or more fiber optic cables in accordance with one or more embodiments of the present disclosure.
Figure 12:
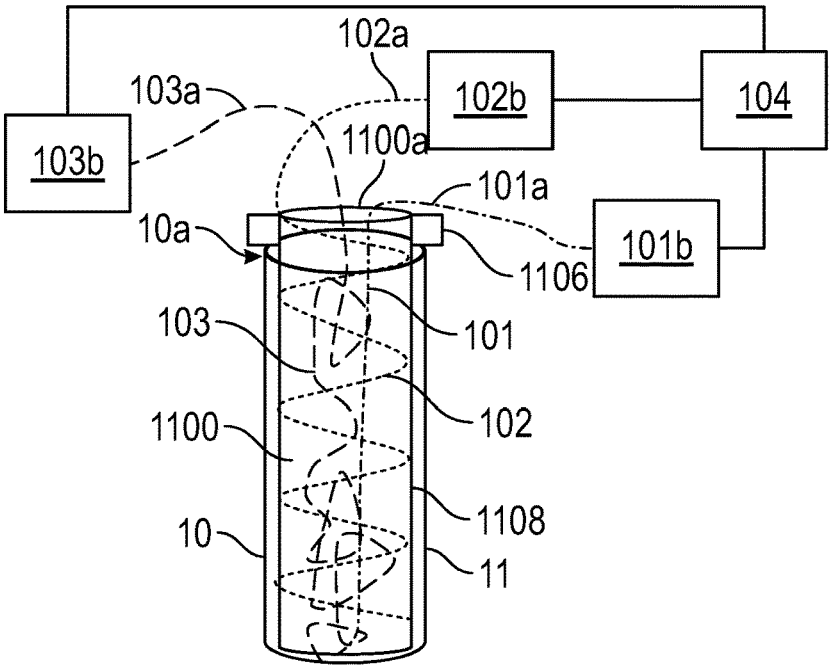
FIG. 12 illustrates a block diagram of the inverted liner of FIG. 11 cured against a wellbore in accordance with one or more embodiments of the present disclosure.

Now referring to FIGS. 11 and 12, another embodiment of a CIPP liner according to embodiments herein is illustrated, where like numerals represent like parts. The embodiment of FIGS. 11 and 12 is similar to that of the embodiment of FIGS. 1 and 2. However, instead of the CIPP liner (100) being inflated, an CIPP liner 1100 is installed in the wellbore 10 via inversion. In inversion, the CIPP liner 1100 is forced by fluid (e.g., water) or gas (e.g., compressed air) to turn itself inside out along the walls 11 of the wellbore 10. For example, the CIPP liner 1100 is inverted such that the inverted CIPP liner 1100 unfurls itself along the walls 11 of the wellbore 10.

As shown in FIG. 11, an end surface 1100*b* of a tube 1100*a* of the inverted CIPP liner 1100 is coupled to a clamp 1106 at the top 10*a* of the wellbore 10. From the clamp 1106, the inverted CIPP liner 1100 is pumped with the fluid (e.g., water) or gas (e.g., compressed air) such that an inner layer 1107 of the tube 1100*a* becomes an outer layer 1108 of the tube 1100*a*. Additionally, the inverted CIPP liner 1100 may be impregnated with a handling/sealing layer outside the tube 1100*a*. For example, when the inverted CIPP liner 1100 is inverted, the handling/sealing layer becomes the inner surface of the inverted CIPP liner 1100. Further, uncured resin can then flow into cracks and openings in the walls 11 of the wellbore 10 to lock the inverted CIPP liner 1100 in place before curing. In one or more embodiments, at the clamp 1106, the fiber optic cables embedded in the inverted CIPP liner 1100 each have a portion (101*a*-103*a*) is not in the wellbore 10.

Similar to FIG. 2. FIG. 12 illustrates the inverted CIPP liner 1100 is pressed against the wellbore 10. For example, once the fluid (e.g., water) or gas (e.g., compressed air) has turned inverted a full length of the inverted CIPP liner 1100, the outer layer 1108 of the tube 1100*a* will be pressed against the walls of the wellbore 10. Once the inverted CIPP liner 1100 has been fully inverted and is against the walls 11 of the wellbore 10, the inverted CIPP liner 1100 will then undergo curing.

Figure 13:
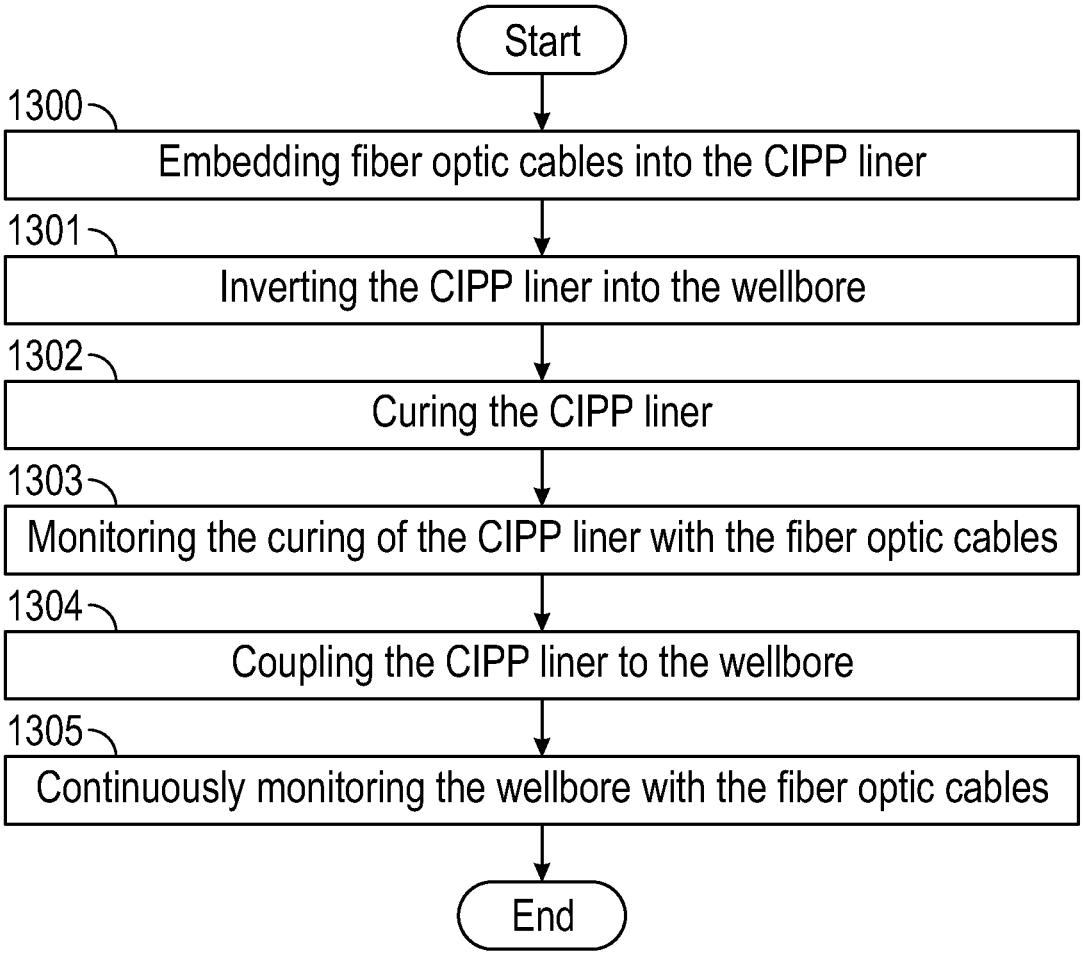
FIG. 13 illustrates a flowchart in accordance with one or more embodiments of the present disclosure.

Now referring to FIG. 13, a flowchart showing a method of installing the inverted CIPP liner 1100 of FIGS. 11 and 12 is illustrated. One or more steps in FIG. 13 may be performed by one or more components (e.g., a computing system coupled to a controller in communication with the inverted CIPP liner 1100). For example, a non-transitory computer readable medium may store instructions on a memory coupled to a processor such that the instructions include functionality for installing the inverted CIPP liner 1100. While the various blocks in FIG. 13 are presented and described sequentially, one of ordinary skill in the art will appreciate that some or all of the steps may be executed in different orders, may be combined or omitted; and some or all of the steps may be executed in parallel. Furthermore, the steps may be performed actively or passively.

In Step 1300, the fiber optic cables are embedded in the CIPP liner. For example, the fiber optic cables may be attached to or woven into the inner layer of the tube of the CIPP liner. During the wet-out process of the tube, the resin impregnates the tube which will also embed the fiber optic cables into the tube. In some embodiments, the fiber optic cables may first be attached to a mat and the mat may then be attached to the tube on the inner layer. Similarly, once the resin impregnates the tube, the mat will be fixed to the tube.

Additionally, the fiber optic cables may be attached to or woven into the tube in various orientations running down the tube. For example, a first fiber optic cable may be arranged in a liner orientation such that the first fiber optic cable runs axially down a length of the tube in a relatively straight line. A second fiber optic cable may be arranged in an oscillating orientation such that the second fiber optic cable runs in a sinusoidal line down the length of the tube. A third fiber optic cable may be arranged in a random orientation such that the third fiber optic cable may run in various directions and shapes down the length of the tube. For example, the third fiber optic cable may be arranged to have various circular loops, curves, and straight lines down the length of the tube.

In Step 1301, the CIPP liner is inverted into the wellbore. For example, an end of the CIPP liner is coupled to a clamp above the wellbore and then the CIPP liner is turned inside out. Additionally, to complete the inversion of the CIPP liner, the fluid (e.g., water) or gas (e.g., compressed air) is pumped in to the CIPP liner such that an inner layer of the CIPP liner becomes an outer layer of the CIPP liner. A predetermined volume of fluid or gas will continue be pumped until the inverted CIPP liner has fully unfurled itself along the walls of the wellbore. The predetermined volume of fluid or gas may correspond to volume which inverts the CIPP liner entirely against the walls of the wellbore. Additionally, to confirm that the CIPP liner has been fully inverted and pressed entirely against the walls of the wellbore, the fiber optic cables may be utilized. For example, the fiber optic cables may be placed in distributed acoustic sensing (DAS) mode to monitor seismic variations and strain occurring on the inverted CIPP liner. If the seismic variations and strain have met predetermined thresholds, the inverted CIPP liner has been fully pressed against the walls of the wellbore. However, if the seismic variations and strain has not met predetermined thresholds, an alert may be sent to continue pumping the fluid or gas until the predetermined thresholds have been met.

In Step 1302, with the inverted CIPP liner against the walls of the wellbore, the inverted CIPP liner will be cured to harden the inverted CIPP liner into a hard liner. For example, the resin within the tube of the inverted CIPP liner is heated to harden the tube into a hard pipe. To heat the resin, various curing methods may be used. For example, hot water, steam, or ultraviolet light may be used to raise the temperature of the inverted CIPP liner to conduct the curing of the resin. In some embodiments, the fluid or gas used to invert the CIPP liner may be heated to start and complete the curing process.

In step 1303, during the curing process, the fiber optic cables monitor the curing of the inverted CIPP liner. For example, at least one of the fiber optic cables is placed in distributed temperature sensing (DTS) mode to monitor a temperature during curing. In DTS mode, the at least one fiber optic cable continuously monitors the temperature along the entire length of the inverted CIPP liner. Based on the recorded temperature, the at least one fiber optic cable can confirm a more complete curing cure throughout the length of the inverted CIPP line. For example, if the recorded temperature has reached a predetermined temperature threshold for a predetermined time, the inverted CIPP liner has been fully cured to turn the inverted CIPP liner into a hard pipe. The predetermined temperature threshold is a temperature required to start curing process (e.g., heating the resin to chemically react). Additionally, the predetermined time is a period of time at which the resin must be heated for at the predetermined temperature threshold to fully cure the inverted CIPP liner. However, if the recorded temperature has not met predetermined temperature threshold, an alert may be sent to continue heating the resin until the predetermined temperature threshold have been met. It is further envisioned that after the predetermined time, the at least one fiber optic cable may be used to record a temperature to confirm that the inverted CIPP liner has been harden. For example, if the recorded temperature after the predetermined time does not meet a predetermined temperature of a harden inverted CIPP liner, an alert may be sent to continue heating the resin until the predetermined temperature is reached.

In Step 1304, once the inverted CIPP liner is cured, the inverted CIPP liner is coupled to the wellbore. For example, as the resin cures, the inverted CIPP liner affixes to the walls of the wellbore. This also allows the fiber optic cables to be couples to the wellbore. Additionally, at least one of the fiber optic cables may be placed in DAS mode to monitor a coupling between the inverted CIPP liner and the wellbore. For example, the at least one of the fiber optic cables continuously monitors vibrations and strain along the entire length of the inverted CIPP liner to confirm that there is sufficient coupling between the inverted CIPP liner and the walls of the wellbore.

In Step 1305, with the inverted CIPP liner coupled to the wellbore, the fiber optic cables continuously monitor the wellbore. For example, the fiber optic cables record well data during wellbore operations such as drilling, completions, and any other downhole operations.

Figure 14:
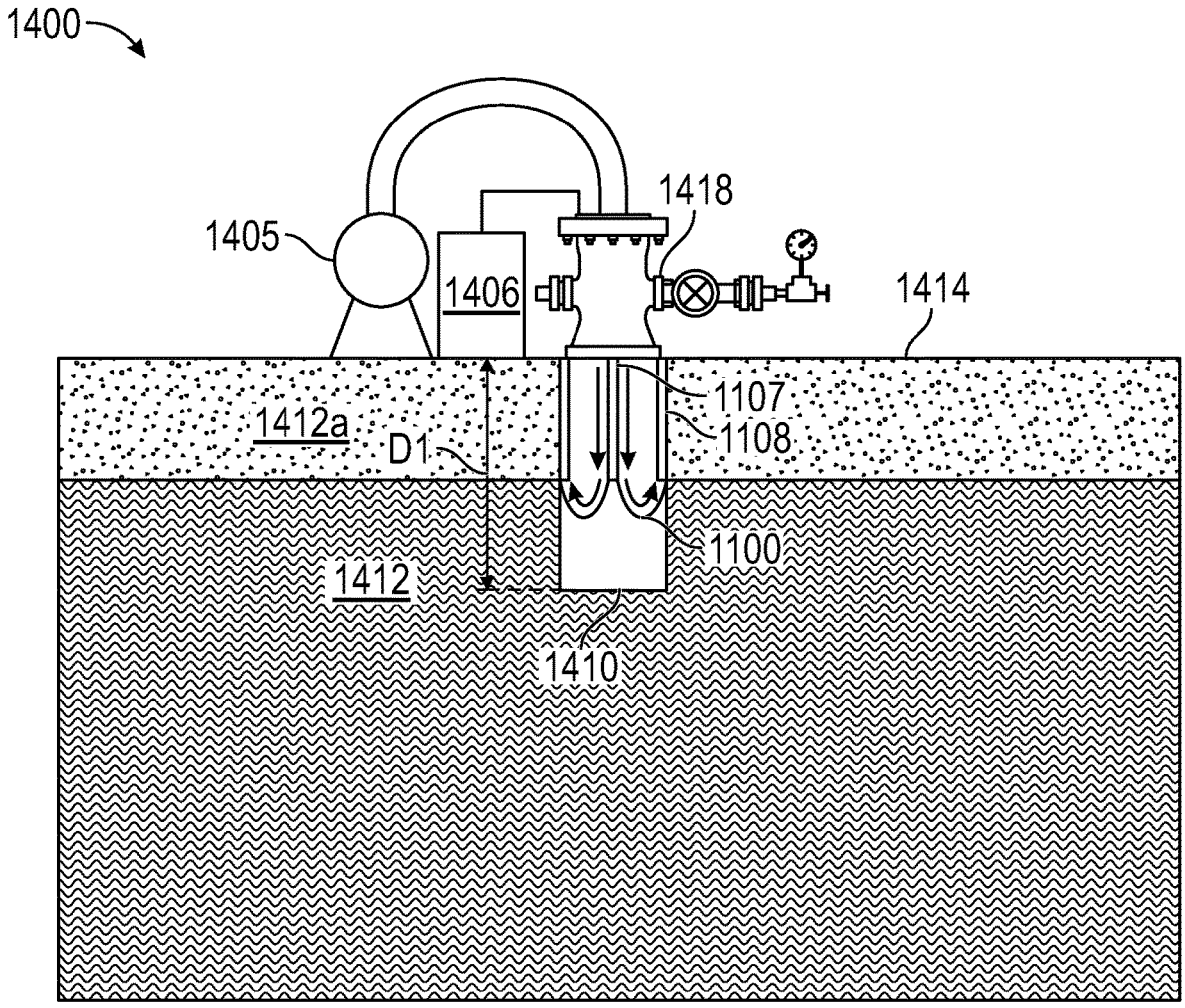
FIGS. 14-18 illustrate implementing the flowchart of FIG. 13 at a well site in accordance with one or more embodiments of the present disclosure.
Figure 15:
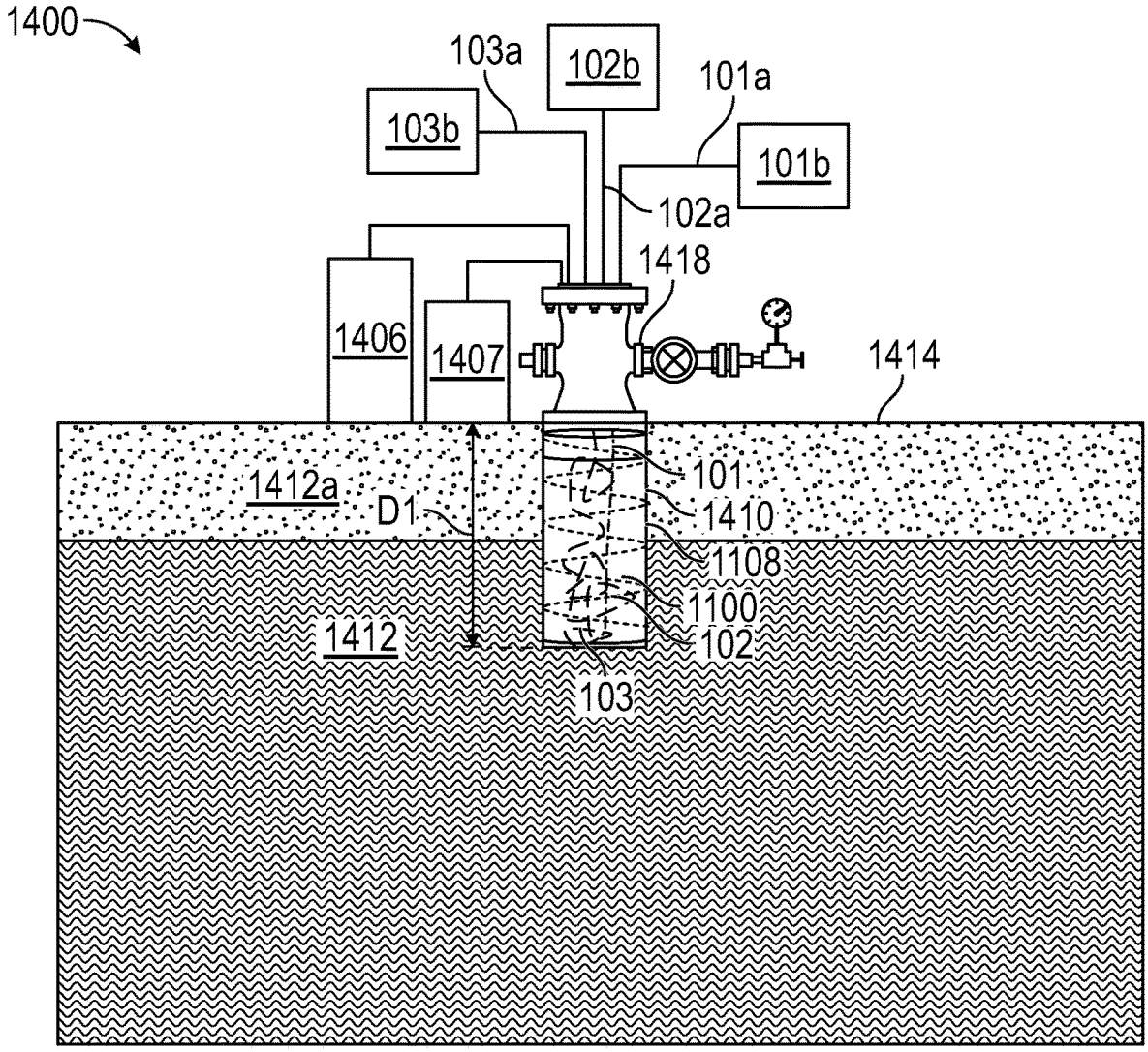
Figure 16:
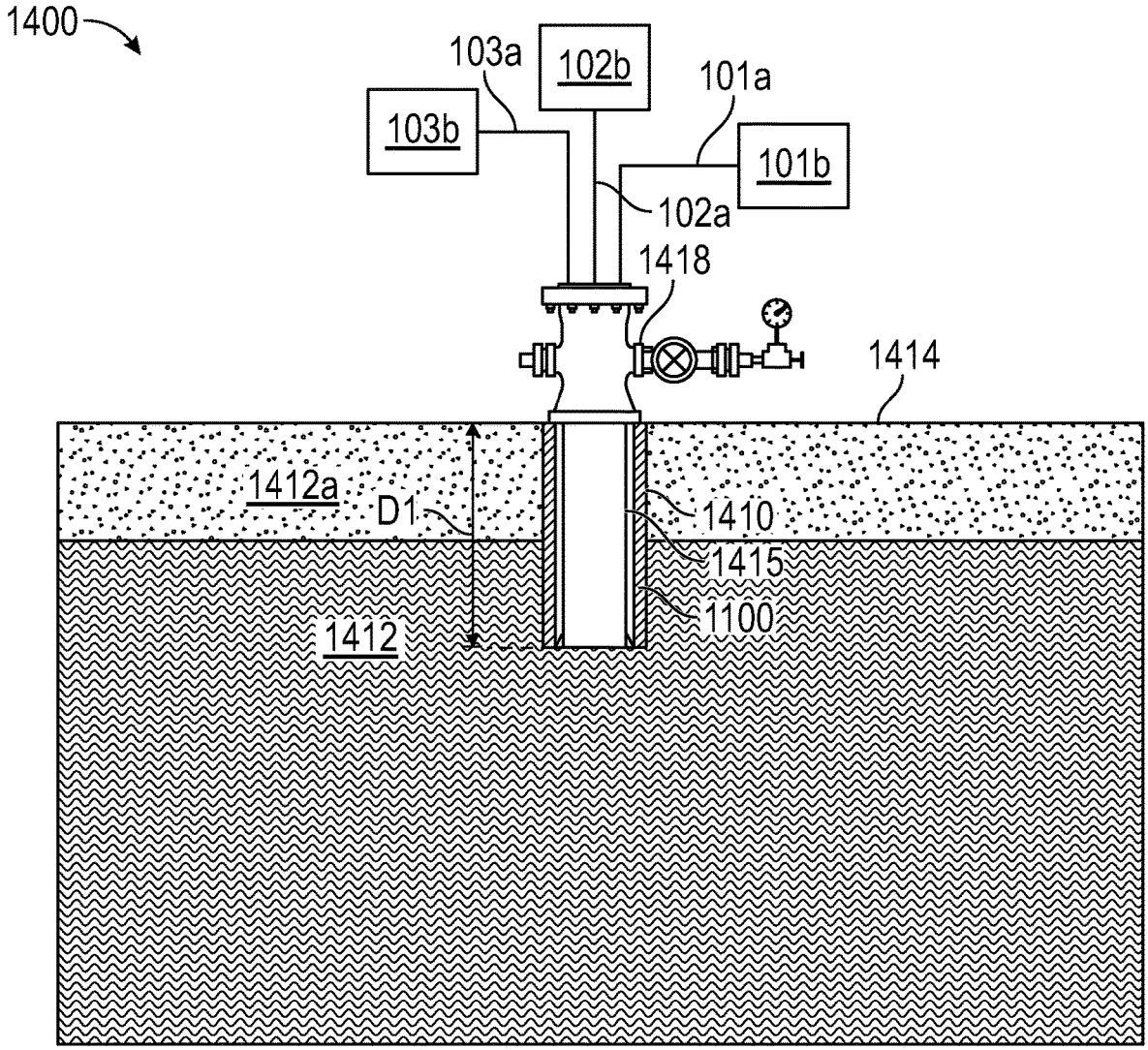

Now referring FIGS. 14-16, in one or more embodiments, FIGS. 14-16 illustrate a system of implementing the method described in the flowchart of FIG. 13 using the CIPP liner 1100 of FIGS. 11 and 12 at a well site 1400.

Turning to FIG. 14, in one or more embodiments, an example of a well site 1400 is illustrated. A wellbore 1410 is formed by drilling into the formation 1412 from a surface 1414. Initially, the wellbore 1410 is drilled a first depth D1 into the formation 1412. This first depth D1 may correspond to shallow section of wellbore 410 drilled in unconsolidated formation 1412*a* of the formation 1412. To support the wellbore 410 in unconsolidated formation 1412*a* of the formation 1412, typically, a conductor casing string is installed and cemented to the wellbore 1410. However, before the conductor casing string is installed, the CIPP liner 1100 is installed in the wellbore 1410.

In one or embodiments, the CIPP liner 1100 is inserted into the wellbore 1410 via inversion. For example, a liner spool 1405 unspools the CIPP liner 1100 into a wellhead 1418 installed on top of the wellbore 1410 at the surface 1414. In the wellhead 1418, an end surface of the CIPP liner 1100 is coupled to a clamp. By coupling end surface of the CIPP liner 1100 to the clamp in the wellhead 1418, the CIPP liner 1100 is turned inside out. Next, a pump 1406, attached to the wellhead 1418, pumps fluid (e.g., water) or gas (compressed air) into the CIPP liner 1100 to force the inner layer 1107 of the CIPP liner 1100 becomes the outer layer 1108 of the CIPP liner 1100.

Turning to FIG. 15, once the CIPP liner 1100 is full inverted, the entire length of the outer layer 1108 of the CIPP liner 1100 is pressed against the wellbore 1410. Additionally, the fiber optic cables (101-103) may also be used to confirm that the CIPP liner 100 has been fully inverted and is entirely against the wellbore 1410. For example, at least one of the fiber optic cables (101-103) may be switched to DAS mode to measure vibrations which correspond to contacting the wellbore 1410.

Once the inverted CIPP liner 1100 is pressed against the wellbore 1410, the inverted CIPP liner 1100 will be cured. For example, a heater 1407 coupled to the wellhead 1418 heats the resin within the inverted CIPP liner 1100 to harden the inverted CIPP liner 1100 into a hard pipe. In some embodiments, the heater 1407 may heat the fluid or gas from the pump 1406 to start and complete the curing process. Alternatively, the heater 1407 may be an ultra-violet lamp that is pulled through the inverted CIPP liner 1100 to heat the resin. As described above, the fiber optic cables (101-103) are utilized for monitoring the curing process. Once the inverted CIPP liner 1100 is cured, the inverted CIPP liner 1100 coupled to the wellbore 1410. For example, the inverted CIPP liner 1100 is turned into a hard pipe affixed to the wellbore 1410.

As shown in FIG. 16, with the inverted CIPP liner 1100 coupled to the wellbore 1410, a conductor casing string 1415 is lowered into the wellbore 1410. The conductor casing string 1415 may be a large-diameter casing that protects shallow formations from contamination by drilling fluid and helps prevent washouts or cave-ins involving unconsolidated topsoils and sediments in the unconsolidated formation 1412*a*. Additionally, the conductor casing string 1415 undergoes a cement operation. For example, the conductor casing string 1415 is cemented with a cement slurry to the inverted CIPP liner 1100. It is further envisioned that the fiber optic cables (101-103) in the inverted CIPP liner 1100 may be used to monitor the cement operations on the conductor casing string 1415. With the conductor casing string 1415 cemented, drilling operations may be conducted to further drill wellbore 1410 into the formation 1412 to reach a reservoir.

Figure 17:
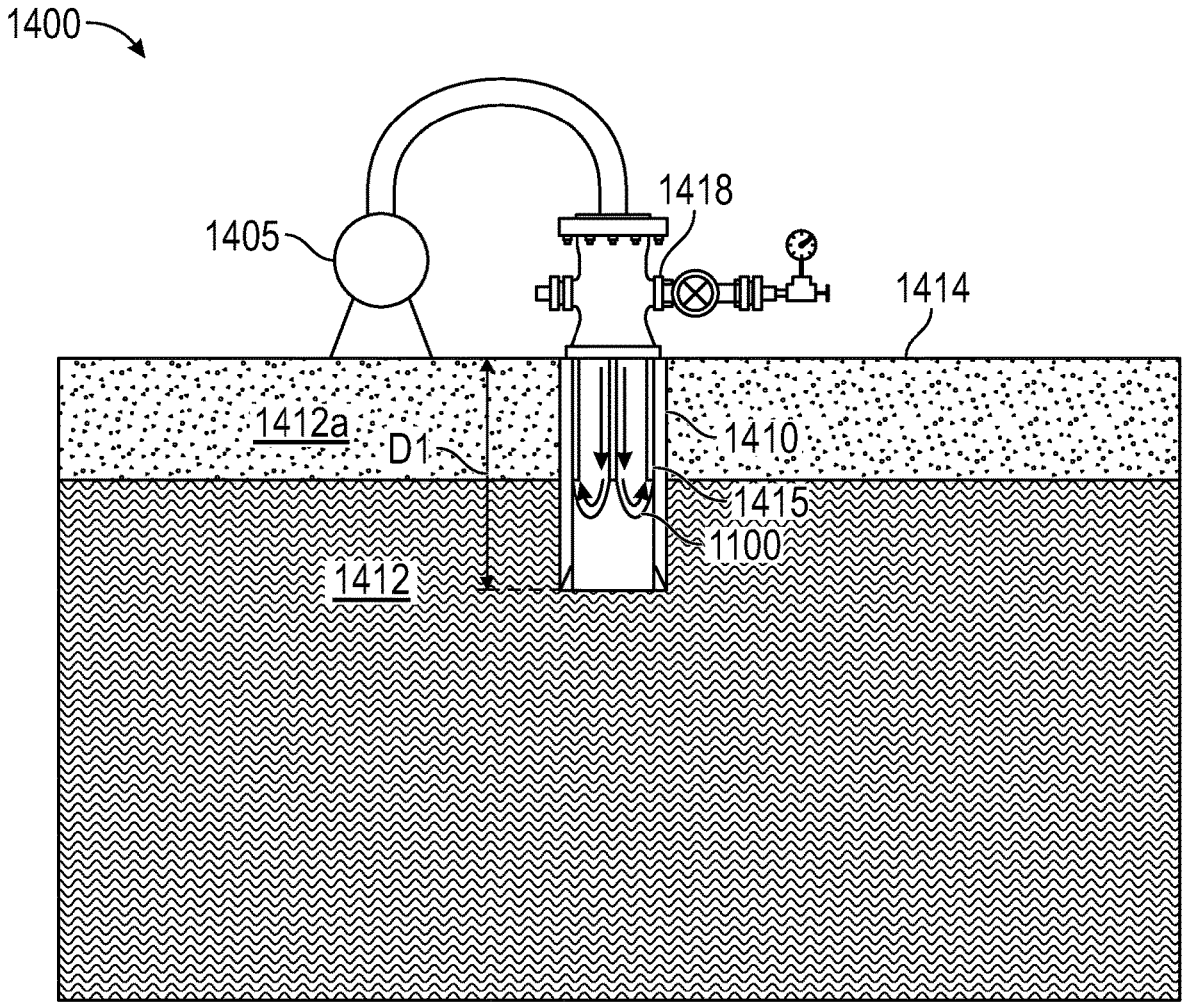
Figure 18:
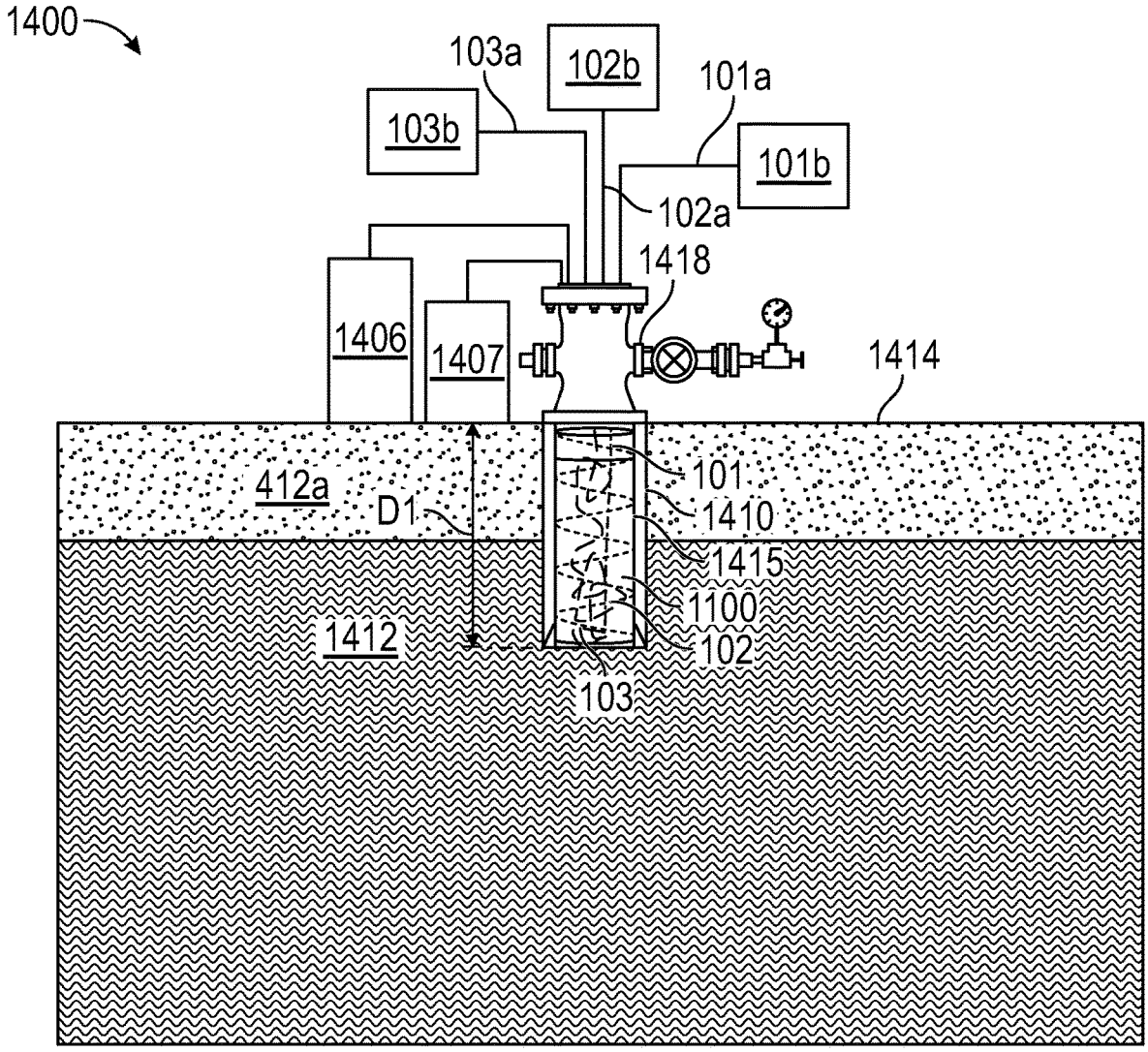

Now referring to FIGS. 17 and 18, another embodiment of installing the CIPP liner 1100 at the well site 1400 according to embodiments herein is illustrated, where like numerals represent like parts. The embodiment of FIGS. 17 and 18 is similar to that of the embodiment of FIGS. 14 and 15. However, instead of installing the CIPP liner 1100 first, the conductor casing string 1415 may be lowered and cemented against the wellbore 1410. After the conductor casing string 1415 is cemented, the CIPP liner 1100 is inverted into the wellbore 1410 against the conductor casing string 1415.

Figure 19:
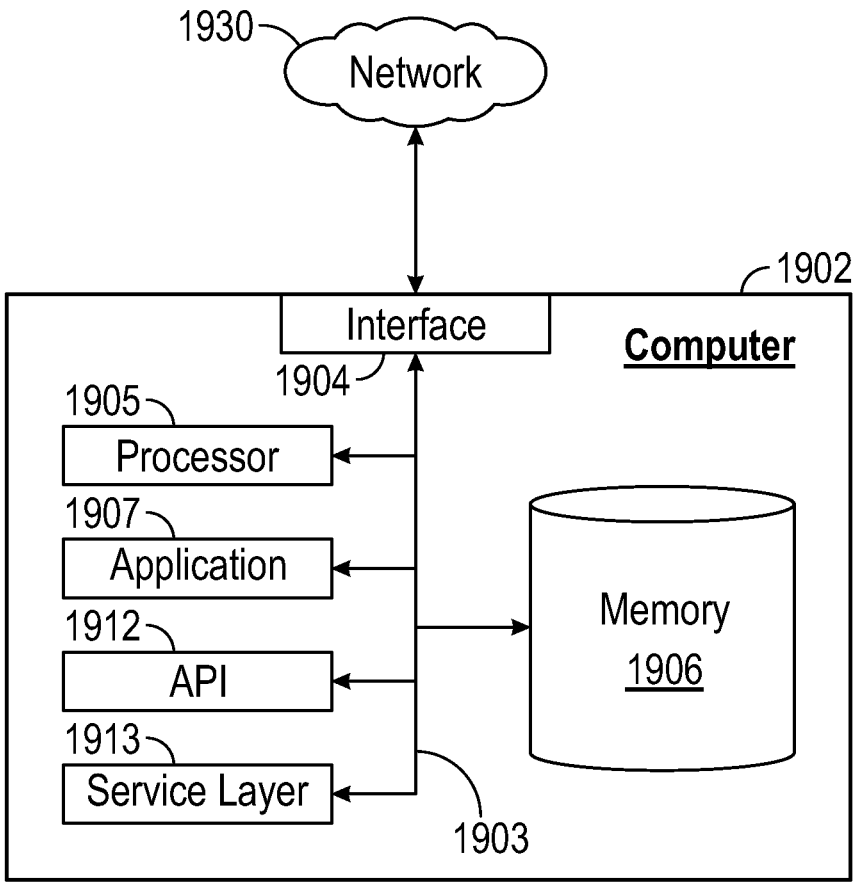
FIG. 19 illustrates a computer system in accordance with one or more embodiments of the present disclosure.

Implementations herein for operating wellbore operations and the fiber optic cables may be implemented on a computing system coupled to a controller in communication with the various components of the CIPP liner. FIG. 19 is a block diagram of a computer system 1902 used to provide computational functionalities associated with described algorithms, methods, functions, processes, flows, and procedures as described in the instant disclosure, according to an implementation. The illustrated computer 1902 is intended to encompass any computing device such as a high-performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 1902 may include a computer that includes an input device, such as a keypad, keyboard, touch screen, or other device that can accept user information, and an output device that conveys information associated with the operation of the computer 1902, including digital data, visual, or audio information (or a combination of information), or a GUI.

The computer 1902 can serve in a role as a client, network component, a server, a database or other persistency, or any other component (or a combination of roles) of a computer system for performing the subject matter described in the instant disclosure. The illustrated computer 1902 is communicably coupled with a network 1930. In some implementations, one or more components of the computer 1902 may be configured to operate within environments, including cloud-computing-based, local, global, or other environment (or a combination of environments).

At a high level, the computer 1902 is an electronic computing device operable to receive, transmit, process, store, or manage data and information associated with the described subject matter. According to some implementations, the computer 1902 may also include or be communicably coupled with an application server, e-mail server, web server, caching server, streaming data server, business intelligence (BI) server, or other server (or a combination of servers).

The computer 1902 can receive requests over network 1930 from a client application (for example, executing on another computer 1902) and responding to the received requests by processing the said requests in an appropriate software application. In addition, requests may also be sent to the computer 1902 from internal users (for example, from a command console or by other appropriate access method), external or third-parties, other automated applications, as well as any other appropriate entities, individuals, systems, or computers.

Each of the components of the computer 1902 can communicate using a system bus 1903. In some implementations, any or all of the components of the computer 1902, both hardware or software (or a combination of hardware and software), may interface with each other or the interface 1904 (or a combination of both) over the system bus 1903 using an application programming interface (API) 1912 or a service layer 1913 (or a combination of the API 1912 and service layer 1913. The API 1912 may include specifications for routines, data structures, and object classes. The API 1912 may be either computer-language independent or dependent and refer to a complete interface, a single function, or even a set of APIs. The service layer 1913 provides software services to the computer 1902 or other components (whether or not illustrated) that are communicably coupled to the computer 1902. The functionality of the computer 1902 may be accessible for all service consumers using this service layer. Software services, such as those provided by the service layer 1913, provide reusable, defined business functionalities through a defined interface. For example, the interface may be software written in JAVA, C++, or other suitable language providing data in extensible markup language (XML) format or other suitable format. While illustrated as an integrated component of the computer 1902, alternative implementations may illustrate the API 1912 or the service layer 1913 as stand-alone components in relation to other components of the computer 1902 or other components (whether or not illustrated) that are communicably coupled to the computer 1902. Moreover, any or all parts of the API 1912 or the service layer 1913 may be implemented as child or sub-modules of another software module, enterprise application, or hardware module without departing from the scope of this disclosure.

The computer 1902 includes an interface 1904. Although illustrated as a single interface 1904 in FIG. 19, two or more interfaces 1904 may be used according to particular needs, desires, or particular implementations of the computer 1902. The interface 1904 is used by the computer 1902 for communicating with other systems in a distributed environment that are connected to the network 1930. Generally, the interface 1904 includes logic encoded in software or hardware (or a combination of software and hardware) and operable to communicate with the network 1930. More specifically, the interface 1904 may include software supporting one or more communication protocols associated with communications such that the network 1930 or interface's hardware is operable to communicate physical signals within and outside of the illustrated computer 1902.

The computer 1902 includes at least one computer processor 1905. Although illustrated as a single computer processor 1905 in FIG. 19, two or more processors may be used according to particular needs, desires, or particular implementations of the computer 1902. Generally, the computer processor 1905 executes instructions and manipulates data to perform the operations of the computer 1102 and any algorithms, methods, functions, processes, flows, and procedures as described in the instant disclosure.

The computer 1902 also includes a memory 1906 that holds data for the computer 1902 or other components (or a combination of both) that can be connected to the network 1930. For example, the memory 1906 can be a database storing data consistent with this disclosure. Although illustrated as a single memory 1906 in FIG. 19, two or more memories may be used according to particular needs, desires, or particular implementations of the computer 1902 and the described functionality. While the memory 1906 is illustrated as an integral component of the computer 1902, in alternative implementations, memory 1906 can be external to the computer 1902.

The application 1907 is an algorithmic software engine providing functionality according to particular needs, desires, or particular implementations of the computer 1902, particularly with respect to functionality described in this disclosure. For example, the application 1907 can serve as one or more components, modules, applications, etc. Further, although illustrated as a single application 1907, the application 1907 may be implemented as multiple applications 1907 on the computer 1902. In addition, although illustrated as integral to the computer 1902, in alternative implementations, the application 1907 can be external to the computer 1902.

There may be any number of computers 1902 associated with, or external to, a computer system containing computer 1902, each computer 1902 communicating over the network 1930. Further, the term "client," "user," and other appropriate terminology may be used interchangeably as appropriate without departing from the scope of this disclosure. Moreover, this disclosure contemplates that many users may use one computer 1902, or that one user may use multiple computers 1902.

In some embodiments, the computer 1902 is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (Saas), mobile "backend" as a service (MBaaS), serverless computing, artificial intelligence (AI) as a service (AIaaS), and/or function as a service (FaaS).

In addition to the benefits described above, the CIPP liner with fiber optic cables may improve an overall efficiency and performance in wells while reducing cost, site safety, reduced risk of non-productive time (NPT), and many other advantages. Further, the CIPP liner with fiber optic cables may provide further advantages such as continuous DAS and DTS within the well, efficiently and effectively measure well data in real-time over the length of the CIPP liner, and reducing or eliminating human interaction with the well to reduce human errors.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for lining a wellbore, the method comprising: inserting a cured-in-place pipe liner into the wellbore;

forcing the cured-in-place pipe liner against walls of the wellbore;

curing the cured-in-place pipe liner;

monitoring the curing of the cured-in-place pipe liner with one or more fiber optic cables embedded in the cured-in-place pipe liner;

coupling the cured-in-place pipe liner to the walls of the wellbore;

continuously monitoring the wellbore with the one or more fiber optic cables;

lowering a casing string into the wellbore; and cementing the casing string against the cured-in-place pipe liner.

2. The method of claim 1, wherein inserting the cured-in-place pipe liner into the wellbore further comprising:

lowering the cured-in-place pipe liner into the wellbore in a deflated state.

3. The method of claim 2, wherein forcing the cured-in-place pipe liner against walls of the wellbore further comprising:

pumping fluid or gas into the cured-in-place pipe liner;

inflating the cured-in-place pipe liner to expand radially outward towards the walls of the wellbore; and pressing the cured-in-place pipe liner against the walls of the wellbore in an inflated state.

4. The method of claim 3, further comprising:

placing at least one of the one or more fiber optic cables in a distributed acoustic sensing mode; and recording vibrations in the cured-in-place pipe liner to confirm the cured-in-place pipe liner is against the walls of the wellbore.

5. The method of claim 4, wherein, if the recorded vibrations does not met a predetermined threshold, the method further comprises:

sending an alert to continue pumping the fluid or gas until the predetermined threshold has been met confirm the cured-in-place pipe liner is against the walls of the wellbore.

6. The method of claim 3, wherein monitoring the curing of the cured-in-place pipe liner with the one or more fiber optic cables further comprises:

placing at least one of the one or more fiber optic cables in a distributed temperature sensing mode; and recording a temperature of the resin to confirm the cured-in-place pipe liner has completed curing into a hard pipe coupled against the walls of the wellbore.

7. The method of claim 6, wherein, if the recorded temperature does not met a predetermined temperature threshold for a predetermined time, the method further comprises:

sending an alert to continue heating the resin until the predetermined temperature threshold has been met to fully cure the cured-in-place pipe liner.

8. A method for lining a wellbore, the method comprising:

inverting a cured-in-place pipe liner into the wellbore;

forcing the cured-in-place pipe liner against walls of the wellbore;

curing the cured-in-place pipe liner;

monitoring the curing of the cured-in-place pipe liner with one or more fiber optic cables embedded in the cured-in-place pipe liner;

coupling the cured-in-place pipe liner to the walls of the wellbore;

continuously monitoring the wellbore with the one or more fiber optic cables;

lowering a casing string into the wellbore; and cementing the casing string against the cured-in-place pipe liner.

9. The method of claim 8, wherein inverting the cured-in-place pipe liner into the wellbore further comprises:

turning the cured-in-place pipe liner inside out.

10. The method of claim 8, further comprising:

coupling an end of the cured-in-place pipe liner to a clamp above the wellbore.

11. The method of claim 8, wherein forcing the cured-in-place pipe liner against walls of the wellbore further comprises:

pumping fluid or gas into the cured-in-place pipe liner;

forcing an inner layer of the cured-in-place pipe liner become an outer layer of the cured-in-place pipe liner; and pressing the outer layer of the cured-in-place pipe liner against the walls of the wellbore.

12. The method of claim 11, further comprising:

placing at least one of the one or more fiber optic cables in a distributed acoustic sensing mode; and recording vibrations in the cured-in-place pipe liner to confirm the outer layer of the cured-in-place pipe liner is against the walls of the wellbore.

13. The method of claim 12, wherein, if the recorded vibrations does not met a predetermined threshold, the method further comprises:

sending an alert to continue pumping the fluid or gas until the predetermined threshold has been met confirm the outer layer of the cured-in-place pipe liner is against the walls of the wellbore.

14. The method of claim 11, wherein monitoring the curing of the cured-in-place pipe liner with the one or more fiber optic cables further comprises:

placing at least one of the one or more fiber optic cables in a distributed temperature sensing mode; and recording a temperature of the resin to confirm the cured-in-place pipe liner has completed curing into a hard pipe coupled against the walls of the wellbore.

15. The method of claim 14, wherein, if the recorded temperature does not met a predetermined temperature threshold for a predetermined time, the method further comprises:

sending an alert to continue heating the resin until the predetermined temperature threshold has been met to fully cure the cured-in-place pipe liner.

16. A system comprising:

a wellbore extending a first depth into a formation;

a cured-in-place pipe liner coupled to walls of the wellbore;

one or more fiber optic cables embedded in the cured-in-place pipe liner to monitor a curing of the cured-in-place pipe liner and record well data, wherein the one or more fiber optic cables are used to continuously monitor the wellbore during a method for lining the wellbore is performed, the method comprising:

inserting the cured-in-place pipe liner into the wellbore;

forcing the cured-in-place pipe liner against walls of the wellbore;

curing the cured-in-place pipe liner;

monitoring the curing of the cured-in-place pipe liner with the one or more fiber optic cables embedded in the cured-in-place pipe liner; and coupling the cured-in-place pipe liner to the walls of the wellbore; and a conductor casing string cemented to the cured-in-place pipe liner.

17. The system of claim 16, wherein the first depth is a section of the wellbore drilled in an unconsolidated formation of the formation.

* * * * *